US009217213B2

(12) United States Patent
Kang

(10) Patent No.: US 9,217,213 B2
(45) Date of Patent: Dec. 22, 2015

(54) LOWER THREAD SUPPLY DEVICE FOR SEWING MACHINE

(76) Inventor: So-Dae Kang, Seoul (KR)

( * ) Notice: Subject to any disclaimer, the term of this patent is extended or adjusted under 35 U.S.C. 154(b) by 198 days.

(21) Appl. No.: 13/818,357

(22) PCT Filed: Aug. 23, 2011

(86) PCT No.: PCT/KR2011/006234

§ 371 (c)(1),
(2), (4) Date: Feb. 22, 2013

(87) PCT Pub. No.: WO2012/026749

PCT Pub. Date: Mar. 1, 2012

(65) Prior Publication Data

US 2013/0160685 A1 Jun. 27, 2013

(30) Foreign Application Priority Data

Aug. 25, 2010 (KR) ..... 10-2010-0082243
Feb. 1, 2011 (KR) ..... 10-2011-0010076
Mar. 16, 2011 (KR) ..... 10-2011-0023358

(51) Int. Cl.
*D05B 57/28* (2006.01)
*D05B 57/14* (2006.01)
(Continued)

(52) U.S. Cl.
CPC ..... *D05B 57/28* (2013.01); *D05B 57/14* (2013.01); *D05B 57/26* (2013.01); *D05B 59/02* (2013.01); *D05B 63/00* (2013.01)

(58) Field of Classification Search
CPC ..... D05B 59/02; D05B 57/14; D05B 57/143; D05B 57/26; D05B 59/00
USPC ..... 112/278, 279, 181, 182, 184, 185, 187, 112/188, 189, 190, 229, 231, 232, 254, 255
See application file for complete search history.

(56) References Cited

U.S. PATENT DOCUMENTS 2,394,369 A * 2/1946 Colegrove ..... 112/228
3,693,566 A * 9/1972 Ketterer ..... 112/184
(Continued)

FOREIGN PATENT DOCUMENTS

DE 1911562 * 11/1970 ..... D05B 57/14
JP 06-292780 A 10/1994
(Continued)

OTHER PUBLICATIONS

The International Search Report dated Mar. 26, 2012, Korean Intellectual Property Office, Korea.

*Primary Examiner* — Tejash Patel
(74) *Attorney, Agent, or Firm* — STIP Law Group LLC

(57) ABSTRACT

The present invention relates to a lower thread supply device for a sewing machine, comprising: a housing (100) which is fixed to a main body of a sewing machine, has a cylindrical shape in which a front side and a back side are opened along a central axis, and has a (a housing cut out portion) (110) formed by cutting the outer circumferential surface of one side; a rotation plate (200) which is connected to a power shaft of a sewing machine, has a disk shape, has a power transmission protrusion (210) formed on the front surface of the disk, and is provided at the back inner lateral side of the housing (100) to rotate; a hook body (300) which is rotatably provided inside the housing (100), has a cylindrical shape with an opened front side, a protrusion receiving part (320) formed at the back outer portion to receive the torque of the rotation plate (200) by being engaged with the power transmission protrusion (210), a bobbin mounting post (330) formed at the back inner portion, and a hook (310) that passes through the loop formed by an upper thread descending along a needle of a sewing machine, thereby pulling the upper thread, provided at the outer circumferential surface of one side; a spool-shaped bobbin (400) which is inserted into the bobbin mounting post (330) of the hook body (300) to be rotatably provided, and to which a lower thread is wound; and a cap (500) which passes through the center of the bobbin (400) to be detachably coupled to the bobbin mounting post (330), thereby preventing the separation of the bobbin from the hook body (300).

71 Claims, 21 Drawing Sheets

(51) Int. Cl.

| | |
|---|---|
| ***D05B 63/00*** | (2006.01) |
| ***D05B 57/26*** | (2006.01) |
| ***D05B 59/02*** | (2006.01) |

(56) References Cited

U.S. PATENT DOCUMENTS

| | | | | | |
|---|---|---|---|---|---|
| 5,165,354 | A | * | 11/1992 | Wahlstrand | 112/228 |
| 5,762,013 | A | * | 6/1998 | Watanabe et al. | 112/181 |
| 6,112,684 | A | * | 9/2000 | Papajewski | 112/185 |
| 7,490,567 | B2 | * | 2/2009 | Sakuma | 112/181 |

FOREIGN PATENT DOCUMENTS

| | | | |
|---|---|---|---|
| JP | 11-197383 | A | 7/1999 |
| JP | 2009-528149 | A | 8/2009 |
| KR | 1019970075023 | | 12/1997 |
| KR | 10-0453606 | | 10/2004 |
| KR | 10-0471639 | | 2/2005 |
| KR | 1020090020861 | A | 2/2009 |
| KR | 1020110133265 | A | 12/2011 |

* cited by examiner (a)

(b)

LOWER THREAD SUPPLY DEVICE FOR SEWING MACHINE

CROSS-REFERENCE TO RELATED APPLICATION

This application claims the benefit of Korean Patent Application No. 10-2010-0082243, filed on Aug. 25, 2010, Korean Patent Application No. 10-2011-0010076, filed on Feb. 1, 2011 and Korean Patent Application No. 10-2011-0023358, filed on Mar. 16, 2011 in the Korean Intellectual Property Office, the disclosure of which is incorporated herein by reference.

TECHNICAL FIELD

The present invention relates to a lower thread supply device of a sewing machine and is new technology that can innovatively enhance a load amount of one time of a lower thread, compared with an existing lower thread supply device while almost equally using an existing sewing machine structure.

BACKGROUND ART

In general, as shown in FIG. 1, in a sewing machine, a rotary hook 100 for supplying a lower thread is installed. Such a rotary hook 100 is mounted in a driving shaft 10 rotatably connected to a power apparatus (power transfer gear) of the sewing machine and includes a hook body 20 called an outer rotary hook, a bobbin case (hereinafter, referred to as a "BC") received in the hook body 20, and a bobbin 40 in which a lower thread is wound.

The BC includes a BC base 30 housed in the hook body 20 and called an inner rotary hook and a BC body 50 for receiving a bobbin at the outside of the bobbin 40.

At the bottom of the BC base 30, a stud 31 is provided, and at the stud 31, the bobbin 40 is rotatably installed.

The BC formed with the BC base 30 and the BC body is integrally formed, and a protrusion 75 of a hook retainer 70 separately installed in a sewing machine body is inserted into a groove 33 to formed in the BC base 30 to prevent the BC from moving. Further, a needle through-hole 34 that is adjacent to the groove 33 and that penetrates a needle when the needle moves downward is formed.

In the bobbin 40, a winding shaft 41 in which the lower thread is wound, and flanges 43 and 45 formed at both ends of the winding shaft 41 are formed.

When the hook body 20 is driven by such a structure, the hook retainer 70 prevents the BC base 30 from rotating along the hook body due to a rotation of the hook body 20 and thus the BC base 30 maintains a fixed state, and an upper thread 3 that is hooked to a hook 21 of the hook body 20 and that revolves over the BC base 30 and the bobbin 40 and that moves upward by hooking a lower thread 4 is guided through the groove 33 (precisely, between a side wall of the groove and the protrusion 75 of the hook retainer within the groove) of the BC base (see FIG. 2).

Therefore, the groove 33 functions as a key groove that inserts the protrusion 75 of the hook retainer, and a width 33*a* thereof is added to a width 75*a* of the protrusion not to have a trouble when the upper thread 3 escapes and thus the groove 33 is formed in a size for securing an upper thread passage gap.

In such a conventional rotary hook 100, when the lower thread wound in the bobbin 40 is consumed, operation of the sewing machine is stopped and the BC body 50 is opened, and the bobbin 40 should be replaced, and in order to replace one bobbin 40, about 1 minute is generally consumed.

When it is assumed that a length of the lower thread wound in the bobbin 40 is 40 meter, a length of a stitch is 1 millimeter, and the reciprocating rotation motion number of a needle bar is 4000 RPM, if 10 minutes have elapsed, entire lower thread is consumed and thus the sewing machine should be stopped every 10 minutes and the bobbin 40 should be replaced, and in a large-sized sewing machine in which a plurality of (e.g., 50 to 100) needle bars and rotary hooks 100 are disposed in a line in a transverse direction, if a wound lower thread of any one of the bobbins 40 is consumed, operation of the sewing machine should be stopped and the entire bobbins 40 should be replaced.

Therefore, work delay (stop) according to replacement of the bobbin 40 and remaining lower threads in the remaining bobbins 40 are entirely disposed and thus a resource is largely wasted.

If more lower threads can be wound in the bobbin 40, such a problem can be considerably solved, but an amount of wound lower threads is limited by a size of an external form of the bobbin 40. That is, in order to increase a load amount of the lower thread, a diameter or a width of the bobbin 40 should be enlarged.

However, when enlarging a diameter or a width of the bobbin 40, the following problems occur.

When a diameter or a width of the bobbin 40 is enlarged, a size of the BC for housing the bobbin 40 should be also enlarged, and when a size of the BC is enlarged, a supply length of the upper thread 3 that moves upward the lower thread 4 by hooking while revolving the BC should be extended.

However, a supply length of the upper thread 3 depends on a stroke distance of a thread take-up crank, and thus a size or a structure of the thread take-up crank should be also changed.

That is, there is a problem that a sewing machine should be newly designed and produced, and when a supply length of an upper thread increases, before the upper thread forms a stitch together with a lower thread, a length that performs a reciprocating motion by vertically penetrating a cloth increases and thus there is a problem that the upper thread itself is damaged and a stitch is not appropriately formed due to a frictional heat.

In order to solve such a frictional heat, it is necessary to reduce the reciprocating motion number of a needle bar, and when the reciprocating motion number is reduced, work efficiency is deteriorated and thus there is a problem that an increase effect of a load amount of the lower thread is decreased.

Therefore, a new concept of lower thread supply device that can increase only a load amount of the lower thread without greatly changing an existing sewing machine structure while maintaining the reciprocating motion number of the needle bar and a supply length of the upper thread 3 is requested.

Further, in a conventional lower thread supply device, as shown in FIG. 1, the hook body 20 is connected to an end portion of the driving shaft 10 and rotates in a high speed and thus even if the hook body 20 is unbalanced a little, there is a problem that the hook body 20 may greatly vibrate and particularly, when a diameter of the hook body 20 is extended, a possibility that such a phenomenon may occur is very high.

Technical Problem

The present invention is made to overcome the above mentioned problems, and it is an object of the present invention is as follows.

A first object of the present invention is to provide a means that can innovatively enhance a lower thread to be loaded at one time.

A second object of the present invention is to provide a means that can increase a load amount of a lower thread while maintaining a supply length of an upper thread by a thread take-up as an important process for making a knot before forming a stitch.

A third object of the present invention is to provide a lower thread supply device of a new structure that can almost equally use an existing sewing machine structure.

A fourth object of the present invention is to provide a new concept of lower thread supply device that can minimize a vibration of a hook body by stably supporting a hook body even at a high speed rotation.

A fifth object of the present invention is to provide a means that can sense the remaining amount of a lower thread and notify a worker of this.

Technical Solution

A technical configuration of the present invention for achieving the above objects is as follows.

To achieve the above objects, there is provided a lower thread supply device for supplying a lower thread of a sewing machine, the lower thread supply device including: a housing 100 that is fixed to a main body of the sewing machine and that has a cylindrical pipe shape in which a front surface and a rear surface are opened along a central axis and in which an outer circumferential surface of one side is cut out to form a housing cutout portion 110; a rotation plate 200 that is connected to a power shaft of the sewing machine and that has a circular plate shape and that has a power transmission protrusion 210 at a front surface of the circular plate and that is installed at an inner side surface of the rear end of the housing 100 for rotating; a hook body 300 that is rotatably installed at the inside of the housing 100 and that has a front surface of an opened cylindrical shape and that has a protrusion receiving portion 320 that is engaged with the power transmission protrusion 210 to receive torque of the rotation plate 200 at the outside of a rear surface and that has a bobbin mounting post 330 at an inner side of the rear surface and that has a hook 310 for pulling an upper thread by passing through a loop formed by the upper thread moved downward along a needle of the sewing machine at an outer circumferential surface of one side; a bobbin 400 that is inserted into the bobbin mounting post 330 of the hook body 300 to be rotatably installed and that has a spool shape in which the lower thread is wound; and a cap 500 that passes through the center of the bobbin 400 and that is detachably coupled to the bobbin mounting post 330 to prevent the bobbin from separating from the hook body 300.

Advantageous Effects

Effects according to a configuration of the present invention are as follows.

First, the present invention can innovatively enhance an amount of a lower thread to be loaded at one time.

In other words, in the present invention, at the inside of a hook body 300 that forms a stitch with a lower thread while pulling and rotating an upper thread, a bobbin 400 is mounted, and entire internal space of the hook body 300 can be used as lower thread load space, however in a conventional lower thread supply device, at the inside of the hook body 20 rotating while pulling an upper thread, the BC base 30 is mounted, and the bobbin 40 is mounted at the inside of the BC base 30, and when sizes of hook bodies (outer diameter and width) are the same, a size (diameter and width) of the bobbin is reduced. That is, in the present invention, a separate BC base 30 is not required at the inside of the hook body 300, unlike a conventional case and thus internal space of the hook body 300 can be used to the maximum and a size of the bobbin 400 is thus enlarged, and a load amount of one time of the lower thread can be remarkably enhanced.

Second, in a process (thread take-up process) for making a knot before forming a stitch, a structure that can reduce a consumption amount of an upper thread pulled by a hook is suggested and thus an outer diameter and a height of a hook body are enlarged and a load amount of the lower thread can be thus enhanced.

That is, in a conventional lower thread supply device shown in FIG. 1, when the hook body 20 pulls an upper thread of a loop form while rotating, the upper thread is hooked to an end portion of one side of a guide rail at an outer circumferential surface of the BC base 30 and thus has a structure pulled while forming two lines of a shape "V" having the hook 21 as the peak, whereby the upper thread is much consumed. However, in the present invention, even if the hook body 300 rotates, one side of an upper thread pulled by a hook 310 is wound to the rear side of the hook body 300 having a hook 310 as the peak, and the other side thereof has a structure pulled to the front side of the hook 310 and the upper thread is pulled as one line instead of two lines up to a predetermined time point, whereby the upper thread is less consumed. Therefore, even if a load amount of a lower thread is innovatively enhanced by enlarging an outer diameter and a height of the hook body 300 in which the bobbin 400 is mounted, a consumption amount of the upper thread pulled by the hook 310 in a thread take-up process does not exceed a conventional upper thread consumption amount.

Third, a most existing sewing machine structure can be used, and when only a lower thread supply device is replaced without newly producing an entire sewing machine, an existing sewing machine can exhibit the same technical effect as that of the present invention.

In other words, a power shaft of an existing sewing machine is used, and it is necessary that a rotation plate 200 and a power shaft of a replaced new lower thread supply device are simple fastened and connected, and thus while a separate additional cost is minimized, a performance of an existing equipment can be innovatively improved.

Fourth, even at a high speed rotation, a hook body is stably supported and a vibration of the hook body can be minimized.

In other words, a structure in which the hook body 300 rotates with housed at the inside of the housing 100 is achieved and thus the housing 100 safely supports the hook body 300 and stably guides a rotation of the hook body 300. Therefore, unlike a conventional case, even at a high speed rotation, a vibration of the hook body 300 can be efficiently prevented.

Fifth, the remaining amount of a lower thread is detected and notified to a worker at an appropriate time point, and thus the worker can estimate a replacement time of the lower thread, and a failure such as erroneous sewing due to shortage (consumption) of the lower thread can be previously prevented.

BEST MODES FOR CARRYING OUT THE INVENTION

Hereinafter, a specific embodiment of the present invention will be described in detail with reference to the accompanying drawings.

Figure 1:
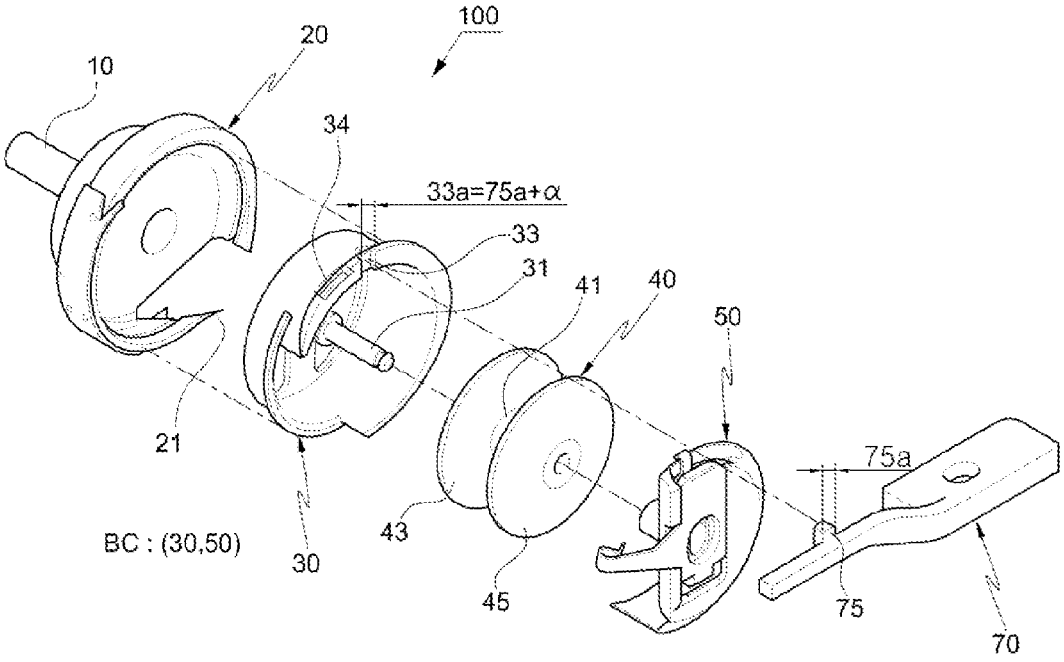
FIG. 1 is an exploded perspective view of a conventional general sewing machine rotary hook.
Figure 2:
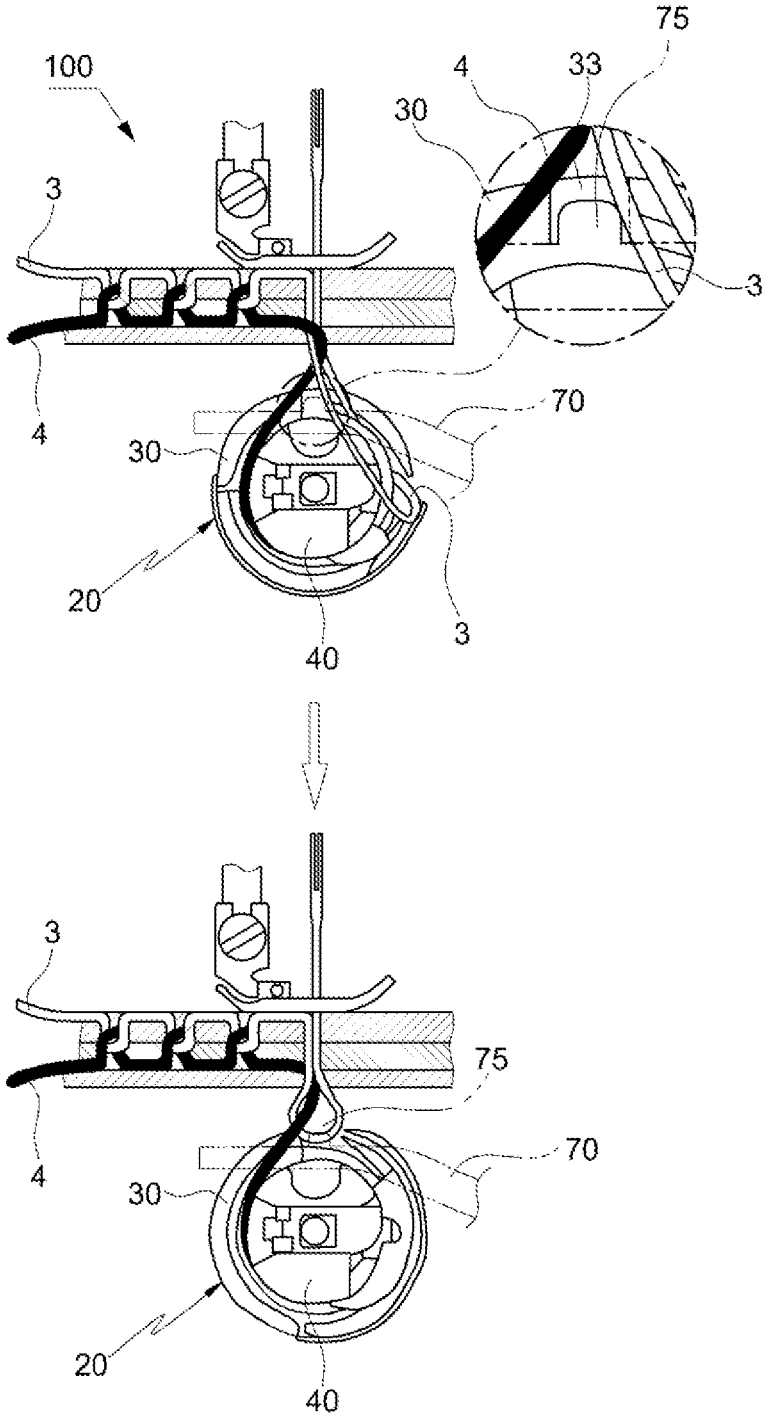
FIG. 2 is a side view illustrating an operation state of a conventional general sewing machine rotary hook.
Figure 3:
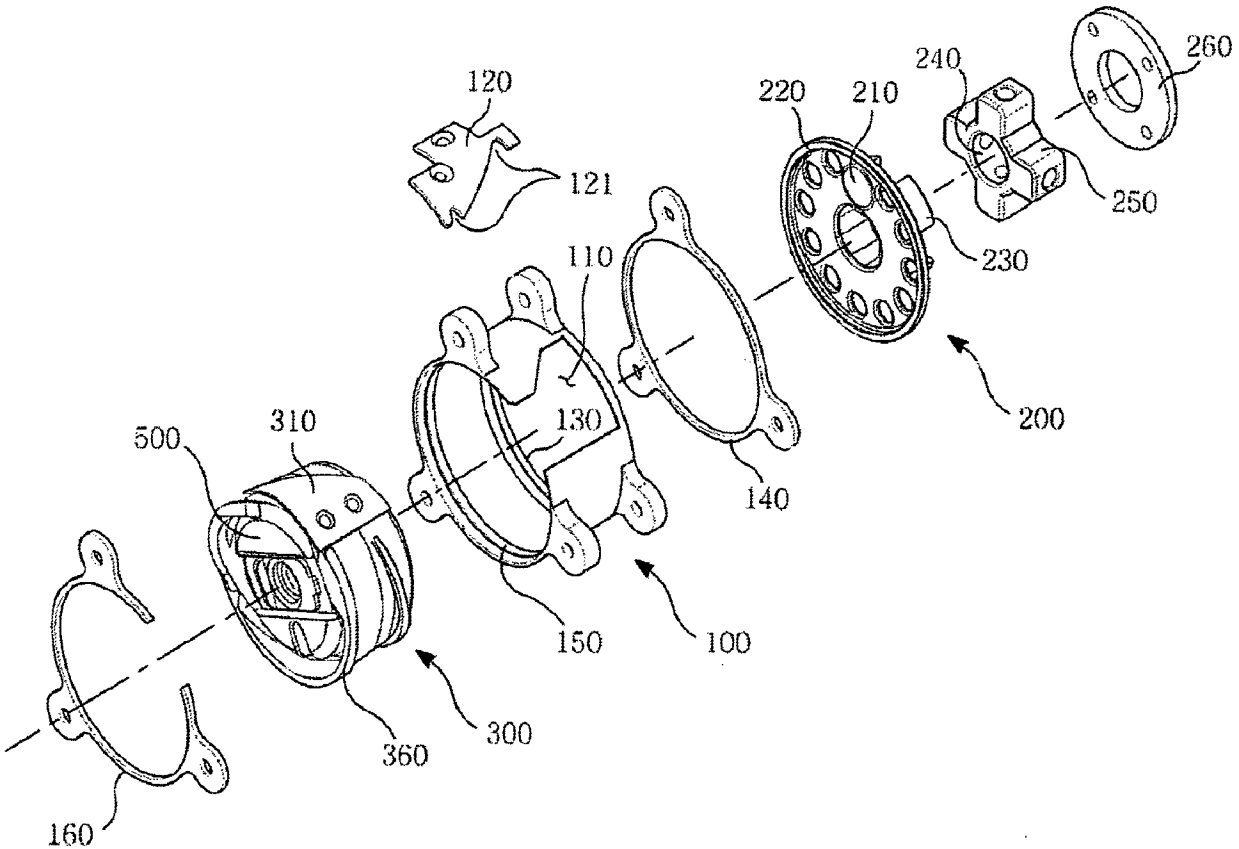
FIG. 3 is an exploded perspective view illustrating a specific embodiment of the present invention.
Figure 4:
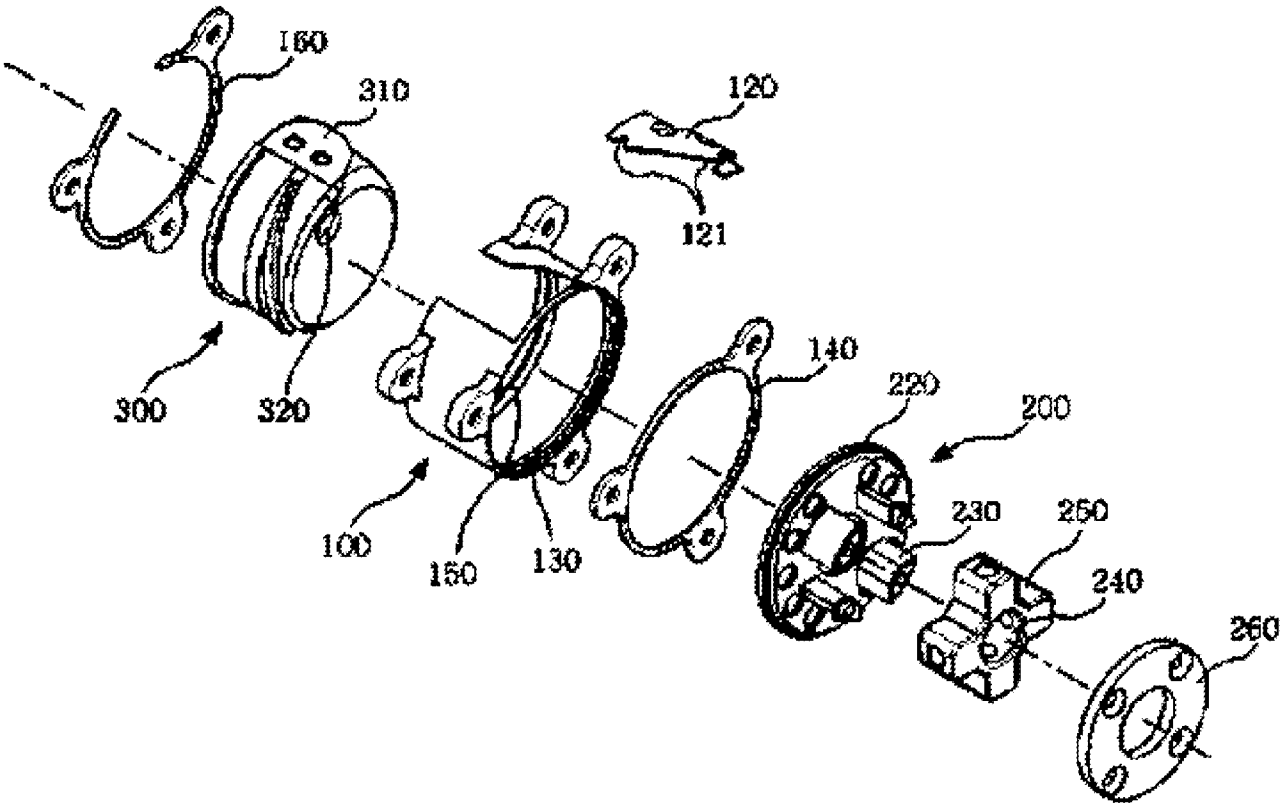
FIG. 4 is an exploded perspective view illustrating a specific embodiment of the present invention seen in an angle different from the exploded perspective view of FIG. 3.
Figure 5:
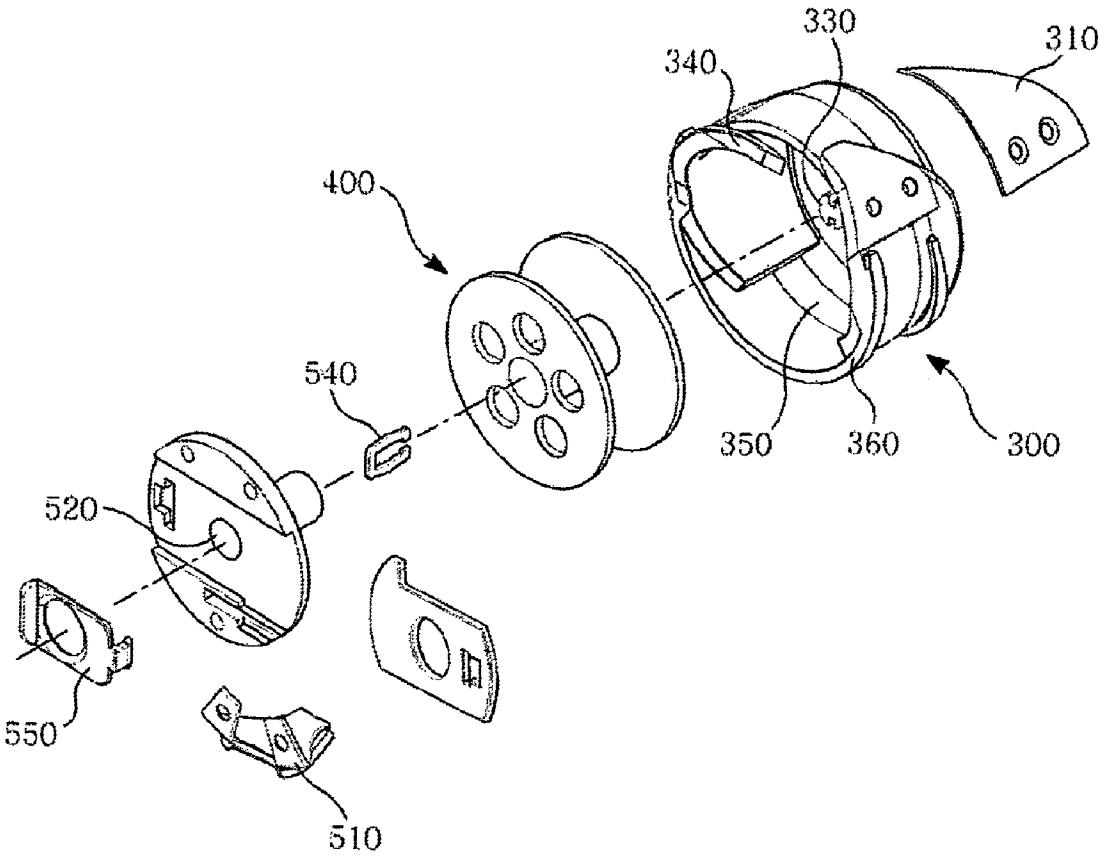
FIG. 5 is an exploded perspective view illustrating a structure of a hook body 300, a bobbin 400, and a cap 500.
Figure 6:
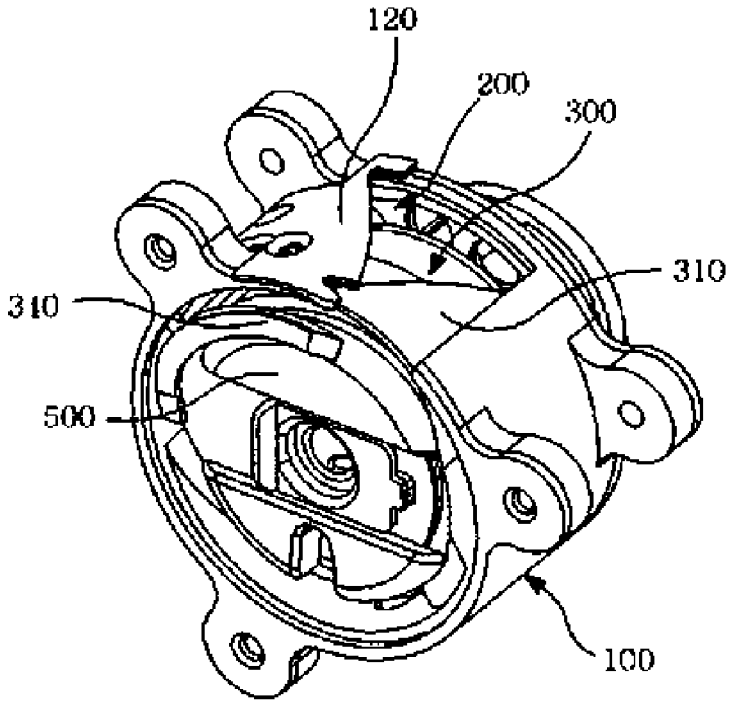
FIG. 6 is an assembled perspective view illustrating a specific embodiment of the present invention.

FIGS. 3 to 5 are exploded perspective views illustrating the present invention, and when constituent elements shown in such exploded perspective views are coupled, a lower thread supply device is complete, as shown in FIG. 6.

A housing 100 is fixed to an appropriate position according to a lower portion of a main body of the sewing machine or a characteristic of the sewing machine and has a cylindrical pipe shape in which a front surface and a rear surface are opened along a central axis.

The housing 100 is fixed to a main body of the sewing machine using generally known various brackets, fixing volts, or pins, and a separate description thereof will be omitted. The housing 100 is fixed to the main body of the sewing machine, and even if a power shaft of the sewing machine rotates, the housing 100 does not rotate and maintains a fixed state.

An outer circumferential surface (portion in which a needle of the sewing machine moves downward) of one side of such a housing is cut out to form a housing cutout portion 110, and the housing cutout portion 110 provides space in which an upper thread of an instantaneously formed loop form while moving upward after being moved downward by being hooked to a needle hole is engaged with a hook 310.

That is, the hook 310 attached to a hook body 300 rotating in the housing cutout portion 110 is engaged with the upper thread while passing through the upper thread that instantaneously forms a loop form according to a motion of the needle and rotates while pulling the upper thread.

An upper thread guide 120 is installed in a direction opposite to the hook 310 at one side of the housing cutout portion 110 of the housing 100, and when the hook 310 rotates while pulling the upper thread, an upper thread guide grooves 121 in which both sides of the upper thread that forms a loop are housed are provided at both sides of the upper thread guide 120.

When the hook 310 of the hook body 300 starts to rotate while pulling the upper thread, the upper thread guide 120 enables both sides of the upper thread forming a loop to always stay at a constant position.

The upper thread guide 120 may have a structure that assembles a separate part in the housing 100 and may be integrally formed with the housing 100.

At the inside of the housing 100, power is transferred between a rotation plate 200 and the hook body 300, and for a stable rotation of the rotation plate 200 and the hook body 300, at an inner side surface of the housing 100, elements that guide a rotation thereof are provided.

As shown in FIG. 3 or 4, a rotation plate guide groove 130 has a shape of a single jaw formed along an inner side surface of the rear end of the housing 100 and performs a function of guiding a rotation movement of the rotation plate 200 together with a rotation plate separation prevention ring 140.

The rotation plate separation prevention ring 140 has a circular ring shape and is coupled to an end portion of the rear side of the housing 100 to prevent the rotation plate 200 from separating from the rotation plate guide groove 130 and ensures a stable rotation movement of the rotation plate 200, space between the rotation plate guide groove 130 and the rotation plate separation prevention ring 140 is space larger than a thickness of a rotation plate guide rail 220 to allow a clearance of a front-rear direction of the rotation plate 200 itself, and an allowance range of such a clearance should be limited to a range that does not release engagement between a power transmission protrusion 210 of the rotation plate 200 and a protrusion receiving portion 320 of the hook body 300.

As shown in FIG. 3 or 4, a hook body guide groove A 150 has a shape of a single jaw formed along an inner side surface of the front end of the housing 100 and performs a function of guiding a rotation movement of the hook body 300 together with the hook body separation prevention ring 160.

A hook body separation prevention ring 160 has a shape in which a partial area corresponding to the housing cutout portion 110 is cut out in a circular ring, is coupled to a front end portion of the housing 100 to prevent the hook body 300 from separating from a hook body guide groove A 150, and ensures a stable rotation movement of the hook body 300.

The rotation plate 200 is connected to a power shaft of the sewing machine and has a circular plate shape, and the power transmission protrusion 210 is formed at a front surface (surface opposite to the hook body 300) of the circular plate.

The rotation plate guide rail 220 is housed at space between the rotation plate separation prevention ring 140 and the rotation plate guide groove 130 of an inner side surface of the rear end of the housing 100 and thus the rotation plate 200 stably rotates, and the rotation plate guide rail 220 is protruded along an outer diameter of the rotation plate 200 to be housed at space between the rotation plate guide groove 130 and the rotation plate separation prevention ring 140, and as shown in FIG. 3 or 4, the rotation plate guide rail 220 may be continuously formed along an outer diameter of the rotation plate 200 and although not separately shown in the accompanying drawings, a plurality of protruded portions may be separated to be protruded in a saw-toothed wheel form while maintaining constant space or a partial area of a protruded outer diameter may have a cutout form.

As shown in FIG. 4, the rotation plate 200 has a structure connected to the power shaft of the sewing machine at a rear surface of a circular plate.

A coupling binding portion 230 is protruded from a rear surface of a circular plate to maintain a constant gap, and in FIG. 4, four protruded portions are arranged at a gap of 90° to form the coupling binding portion 230, and two, three, or five or more protruded portions may be separately arranged, as needed.

At the center of a coupling 250, a power shaft binding hole 240 for inserting and coupling the power shaft of the sewing machine is provided, and the coupling 250 is radially extended about the power shaft binding hole 240 to entirely form a cross (+) form and is housed in space between the coupling binding portions 230.

At the center of a coupling separation prevention plate 260, a hollow that passes through the power shaft of the sewing machine is formed to be coupled to an end surface of the rear side of the coupling binding portion 230, thereby preventing the coupling 250 from separating.

The coupling 250 coupled in this way has a clearance to allow a sliding movement in the front-rear direction in a state coupled to the coupling binding portion 230, and a clearance range should be limited to a range that does not release engagement between the power transmission protrusion 210 of the rotation plate 200 and the protrusion receiving portion 320 of the hook body 300. This is because a clearance is so wide, and as the rotation plate 200 and the coupling separation prevention plate 260 recede together to the rear side along the power shaft of the sewing machine and thus when engagement between the power transmission protrusion 210 of the rotation plate 200 and the protrusion receiving portion 320 of the hook body 300 is released, torque of the power shaft is not transferred to the hook body 300.

As shown in FIGS. 3, 4, and 5, the hook body 300 is rotatably installed at the inside of the housing 100 and has a cylindrical shape having an opened front surface.

At the outside of a rear surface of the hook body 300, the protrusion receiving portion 320 that receives torque of the rotation plate 200 by engaging with the power transmission protrusion 210 of the rotation plate 200 is formed, and at the inside of a rear surface thereof, a bobbin mounting post 330 is formed.

As shown in FIG. 5, at an outer circumferential surface of the hook body 300, the hook 310 pulling the upper thread by passing through a loop formed by the upper thread moved downward along the needle of the sewing machine is provided.

In a state in which the power transmission protrusion 210 of the rotation plate 200 and the protrusion receiving portion 320 of the hook body 300 are engaged, when the rotation plate 200 rotates, the hook body 300 rotates with the rotation plate 200 in the same rotation speed by interlocking with a rotation of the rotation plate 200, a clearance for discharging the upper thread should be secured between the power transmission protrusion 210 and the protrusion receiving portion 320.

Figure 8:
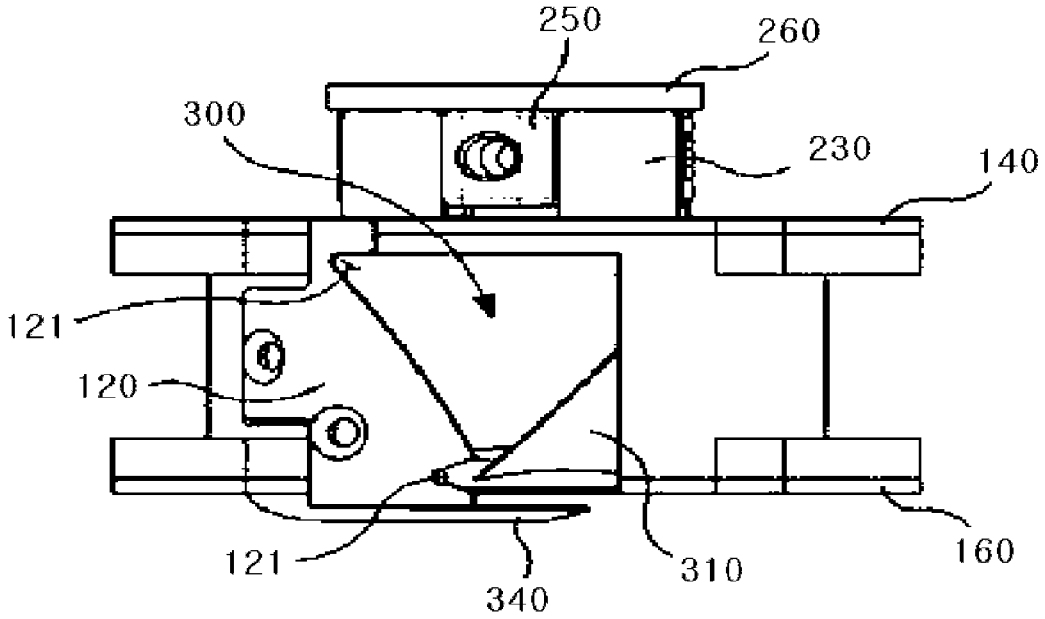
FIG. 8 is a top plan view illustrating a specific embodiment of the present invention.

As shown in FIGS. 5 and 8, the lower thread guide A 340 starts from a direction opposite to the hook 310 of the hook body 300, is extended to be separated from the hook 310, and is positioned at the front side of the hook body 300, and the lower thread guide A 340 performs a function of maintaining a gap so that the lower thread supplied from a bobbin 400 does not meet with the hook 310.

At an outer circumferential surface of the front end of the hook body 300, a hook body guide rail A 360 that is housed at space between the hook body guide groove A 150 and the hook body separation prevention ring 160 and that perform a rotation movement is protruded to guide a stable rotation of the hook body 300.

Figure 7:
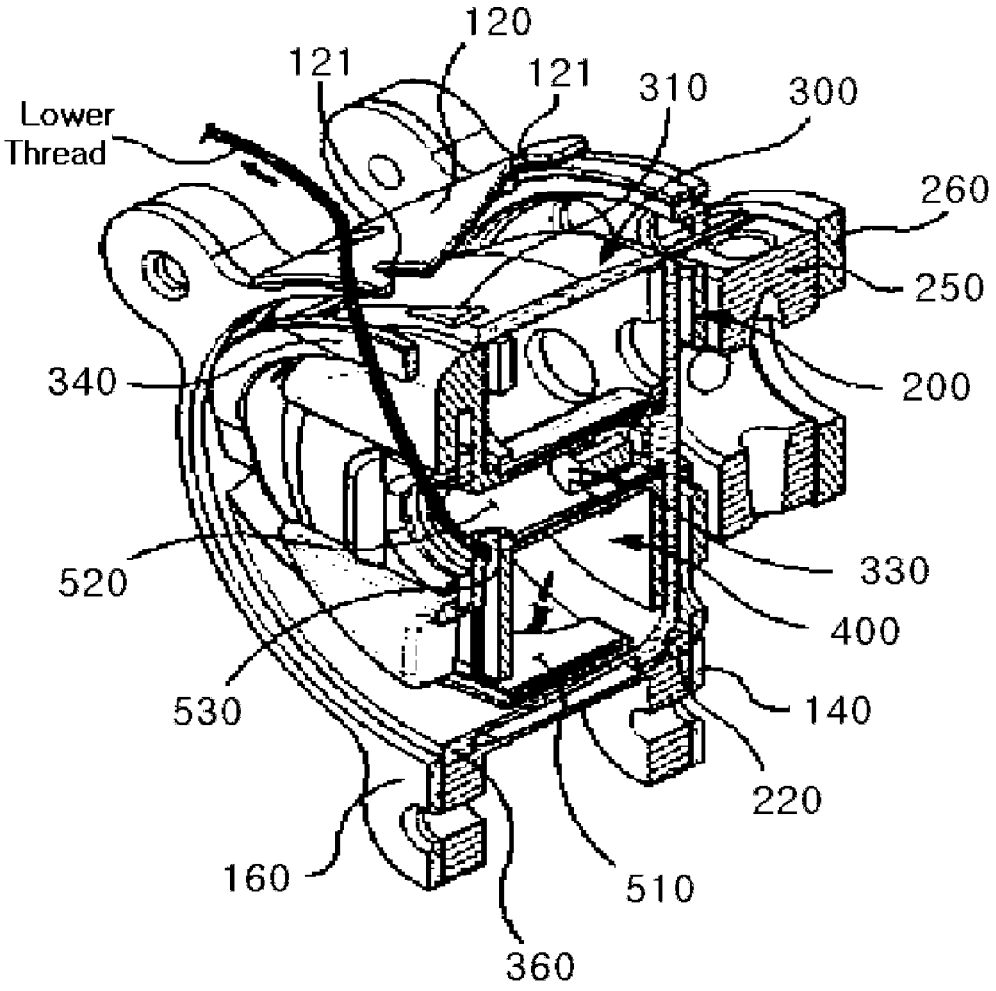
FIG. 7 is a perspective view illustrating a cross-sectional structure of an assembled state of a specific embodiment of the present invention.

As shown in FIG. 5, the bobbin 400 has the same structure as that of a general spool in which the lower thread is wound. As shown in FIGS. 5 and 7, the bobbin 400 is rotatably inserted into the bobbin mounting post 330 of the hook body 300.

As shown in FIGS. 5 and 7, a cap 500 is detachably coupled to the bobbin mounting post 330 by passing through the center of the bobbin 400 to prevent the bobbin from separating from the hook body 300.

The cap 500 is detachably coupled to the bobbin mounting post 330 through a cap detachment lever 550 and a clip 540, and when pulling the cap detachment lever 550 to the front side, coupling between the clip 540 and the bobbin mounting post 330 is released, and the cap 500 may be separated, and in a state in which the bobbin 400 is mounted, when the cap is pushed, binding between the clip 540 and the bobbin mounting post 330 is performed to prevent the cap 500 from separating.

Although not separately shown in the accompanying drawing, at an inner side surface of the cap 500, an elastic body such as a flat spring that elastically supports one side surface of the bobbin 400 is further provided to control a rotation speed of the bobbin 400, thereby preventing the bobbin 400 from idling, and an existing lower thread supply device has a similar function due to such a structure and therefore a specific illustration or description thereof will be omitted.

As shown in FIG. 5, one side of a tension adjustment piece 510 is coupled to one side of the front side of the cap 500, and the other side thereof is inserted into a binding groove 350 formed in an inner circumferential surface of the hook body 300, and the tension adjustment piece 510 applies a constant tension to the lower thread that forms a stitch by meeting with the upper thread by appropriately pressing the lower thread unwound from the bobbin 400 with a constant elastic force together with a guide function of passing though the lower thread unwound from the bobbin 400. Further, in order to form a stitch, at the moment that the upper thread moves upward while pulling the lower thread, the tension adjustment piece 510 appropriately adjusts a speed in which the lower thread is unwound by resisting with an appropriate tension, thereby preventing a backlash phenomenon.

That is, as shown in FIG. 7, the lower thread unwound from the bobbin 400 passes though the inside of the tension adjustment piece 510, and in this process, the tension adjustment piece 510 gently grasps the lower thread by an elastic force.

In the cap 500, a cap hole 520 that penetrates a central portion is formed, and at a side surface of the front side in which the tension adjustment piece 510 is mounted, a lower thread penetration hole A 530 communicating with the cap hole 520 is formed.

As shown in FIG. 7, the lower thread, having passed through the tension adjustment piece 510 is discharged to the front side of the cap 500 by passing through the lower thread penetration hole A 530 and the cap hole 520, and the discharged lower thread moves upward and meets with the lower thread guide A 340, and forms a stitch with the upper thread at a cloth, and a constant tension operates in the lower thread between the cloth and the cap hole 520 by operation of the tension adjustment piece 510, and the lower thread is thus in a somewhat pulled state to smoothly form a stitch with the upper thread.

FIGS. 7 and 8 are an assembled complete view illustrating a specific embodiment of the present invention; FIG. 7 is a cross-sectional view of an assembled state of elements illustrating a cross-sectional structure, and FIG. 8 illustrates an external form thereof.

When a power shaft of the sewing machine rotates, the rotation plate 200 connected thereto rotates, and because the power transmission protrusion 210 of the rotation plate 200 and the protrusion receiving portion 320 of the hook body 300 are engaged, the hook body 300 rotates together with the rotation plate 200.

Further, because the cap 500 is in a state engaged with the hook body 300 by the tension adjustment piece 510, the cap 500 rotates together with the hook body 300.

When the hook 310 of the hook body 300 rotates while pulling the upper thread, the upper thread of a loop form is wound to a front-rear surface of the hook body 300. In this case, the upper thread wound to a rear surface of the hook body 300 passes through space between the hook body 300 and the rotation plate 200, and a clearance for passing through the upper thread is formed between the power transmission protrusion 210 of the rotation plate 200 and the protrusion receiving portion 320 of the hook body 300. Further, the upper thread guide 120 performs a function of guiding the upper thread to well wind the front and rear surfaces of the hook body 300.

FIGS. 9 to 13 illustrate exemplary embodiments having a sensor for sensing the remaining amount of the lower thread.

Figure 9:
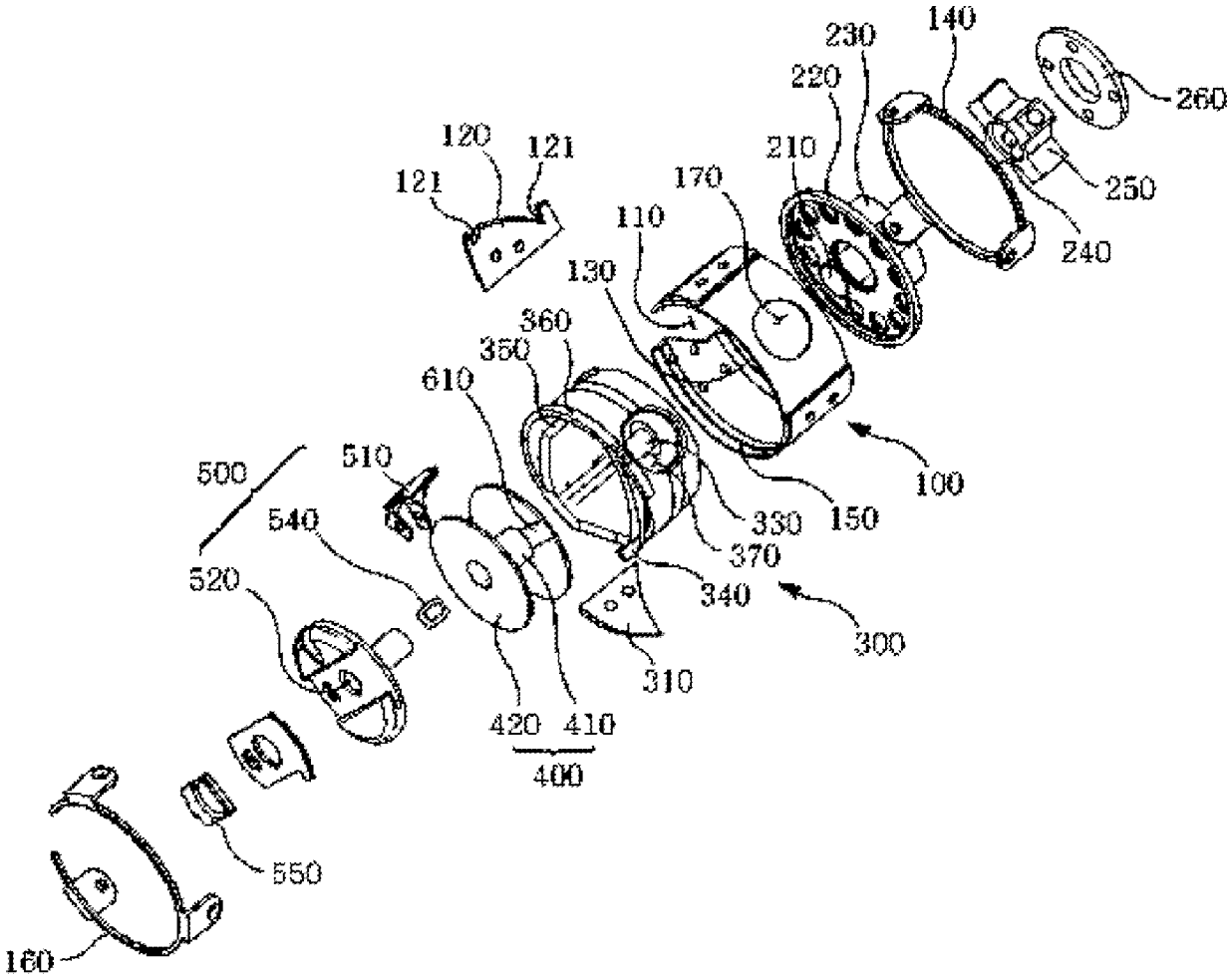
FIG. 9 is an exploded perspective view illustrating a specific embodiment of the present invention.
Figure 10:
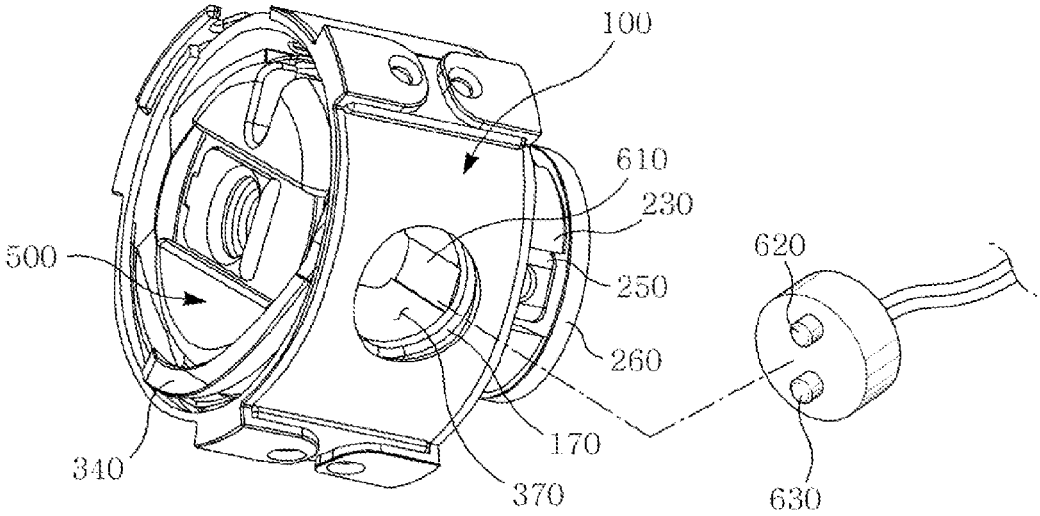
FIG. 10 is an assembled perspective view illustrating a specific embodiment of the present invention.
Figure 11:
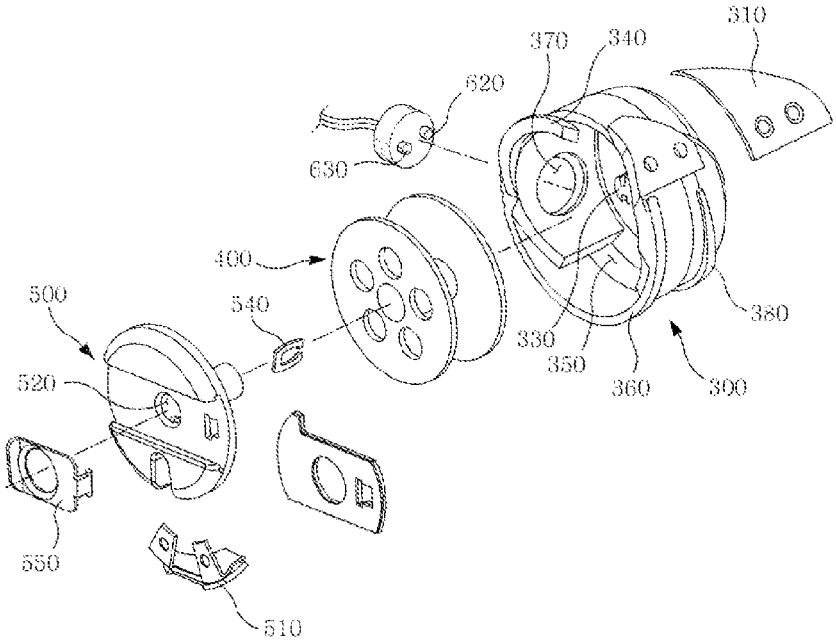
FIG. 11 is an exploded perspective view illustrating a structure of a hook body 300, a bobbin 400, and a cap 500.
Figure 12:
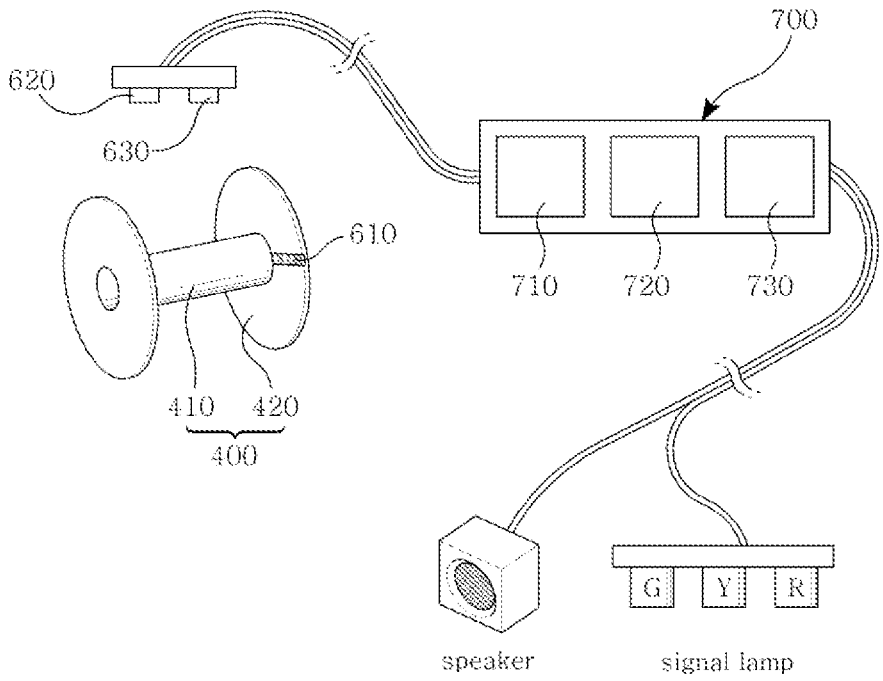
FIG. 12A illustrates a case where a bar code 610 is attached to a flange 420 of a bobbin 400.
FIG. 12B illustrates a case where a bar code 610 is attached to a rotation shaft 410 of a bobbin 400.
Figure 12:
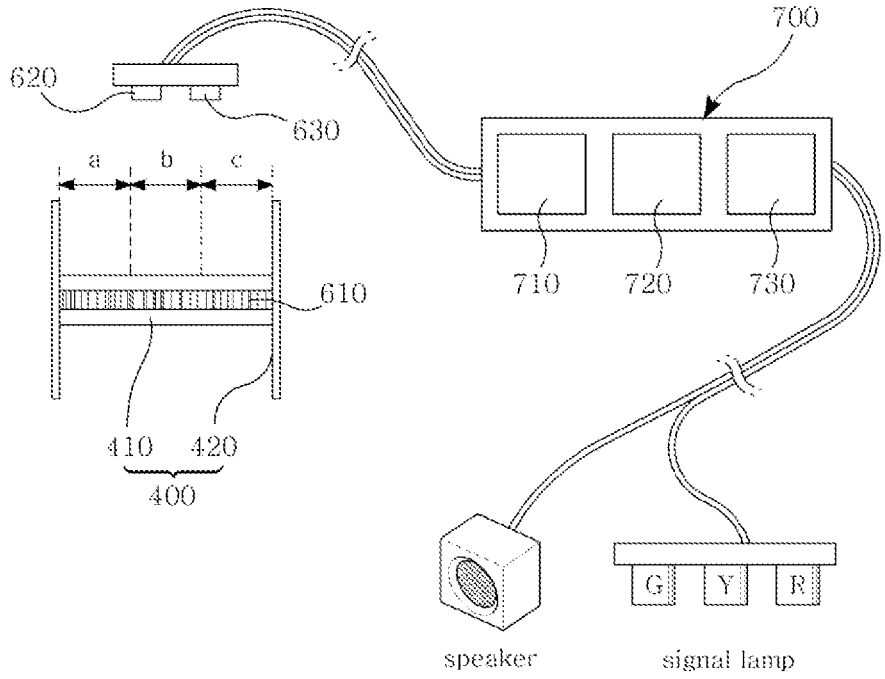

FIG. 9 is an exploded perspective view of the present invention, and when constituent elements shown in such an exploded perspective view are coupled, a lower thread supply device shown in FIG. 10 is complete. FIG. 11 is an exploded perspective view separately illustrating a coupling relation of the bobbin 400, the cap 500, and the hook body 300.

The housing 100 is fixed to a main body of the sewing machine and has a cylindrical pipe shape in which a front surface and a rear surface are opened along a central axis.

The housing 100 is fixed to a main body of the sewing machine using generally known various brackets, fixing volts, or pins, and a separate description thereof will be omitted. The housing 100 is fixed to the main body of the sewing machine, and even if the power shaft of the sewing machine rotates, the housing 100 does not rotate and maintains a fixed state.

An outer circumferential surface (portion in which a needle of the sewing machine moves downward) of one side of such a housing is cut out to form the housing cutout portion 110, and the housing cutout portion 110 provides space in which the upper thread moving downward in a loop form by being hooked by a needle is engaged to the hook 310.

That is, after the hook 310 attached to the hook body 300 rotating in the housing cutout portion 110 is engaged with the upper thread while passing through the upper thread of a loop form moved downward along the needle, the hook 310 rotates while pulling the upper thread.

The upper thread guides 120 are installed in a direction opposite to the hook 310 at one side of the housing cutout portion 110 of the housing 100 and are provided at both sides of the upper thread guide groove 121 in which both sides of the upper thread forming a loop are housed when the hook 310 rotates while pulling the upper thread.

When the hook 310 of the hook body 300 starts to rotate while pulling the upper thread, the upper thread guide 120 enables both sides of the upper thread forming a loop to always position at a constant position.

The upper thread guide 120 may have a structure that assembles a separate part in the housing 100 and may formed integrally with the housing 100.

At the inside of the housing 100, power is transferred between the rotation plate 200 and the hook body 300, and for a stable rotation of the rotation plate 200 and the hook body 300, at an inner side surface of the housing 100, element that guide a rotation thereof are provided.

As shown in FIG. 9, the rotation plate guide groove 130 has a shape of a single jaw formed along an inner side surface of the rear end of the housing 100 and performs a function of guiding a rotation movement of the rotation plate 200 together with the rotation plate separation prevention ring 140.

The rotation plate separation prevention ring 140 has a circular ring shape and is coupled to an end portion of the rear side of the housing 100 to prevent the rotation plate 200 from separating from the rotation plate guide groove 130 and to ensure a stable rotation movement of the rotation plate 200, and space between the rotation plate guide groove 130 and the rotation plate separation prevention ring 140 is space larger than the rotation plate guide rail 220 and allows a clearance in a front-rear direction of the rotation plate 200 itself, and an allowance range of the clearance should be limited to a range that does not release engagement between the power transmission protrusion 210 of the rotation plate 200 and the protrusion receiving portion 320 of the hook body 300.

As shown in FIG. 9, the hook body guide groove A 150 has a shape of a single jaw formed along an inner side surface of the front end of the housing 100 and performs a function of guiding a rotation movement of the hook body 300 together with the hook body separation prevention ring 160.

The hook body separation prevention ring 160 has a shape in which a partial area corresponding to the housing cutout portion 110 is cut out in a circular ring and is coupled to an end portion of the front side of the housing 100 to prevent the hook body 300 from separating from the hook body guide groove A 150 and ensures a stable rotation movement of the hook body 300.

As shown in FIGS. 9 and 10, at an outer circumferential surface of the housing 100, a sensor mounting device 170 is penetrated, separately from the housing cutout portion 110. At the sensor mounting device 170, a bar code sensor 620 or an RFID reader 680 for determining the remaining amount of the lower thread wound in the bobbin 400 may be mounted, and in some case, a light source unit 630 may be mounted together with the bar code sensor 620 or the RFID reader 680 or only the light source unit 630 may be mounted.

The rotation plate 200 is connected to a power shaft of the sewing machine and has a circular plate shape, and the power transmission protrusion 210 is formed at a front surface (surface opposite to the hook body 300) of the circular plate.

The rotation plate guide rail 220 is housed at space between the rotation plate separation prevention ring 140 and the rotation plate guide groove 130 of an inner side surface of the rear end of the housing 100 and thus the rotation plate 200 performs a stable rotation, and the rotation plate guide rail 220 is protruded along an outer diameter of the rotation plate 200 to be housed at space between the rotation plate guide groove 130 and the rotation plate separation prevention ring 140, and as shown in FIG. 9, the rotation plate guide rail 220 may be continuously formed along an outer diameter of the rotation plate 200, and although not separately shown in the accompanying drawings, a plurality of protrusions may be separated to be protruded in a saw-toothed wheel shape while maintaining constant space or a partial area of a protruded outer diameter may have a cutout form.

As shown in FIG. 9, the rotation plate 200 may have a structure connected to the power shaft of the sewing machine at a rear surface of a circular plate.

The coupling binding portion 230 is protruded from a rear surface of a circular plate to maintain a constant gap, and in FIG. 4, four protruded portions are arranged at a gap of 90° to form the coupling binding portion 230, and two, three, or five or more protruded portions may be separately arranged, as needed.

At the center of the coupling 250, the power shaft binding hole 240 for inserting and coupling the power shaft of the sewing machine is provided, and the coupling 250 is radially extended about the power shaft binding hole 240 to entirely form a cross (+) form and is housed in space between the coupling binding portions 230.

At the center of the coupling separation prevention plate 260, a hollow that passes through the power shaft of the sewing machine is formed to be coupled to an end surface of the rear side of the coupling binding portion 230, thereby preventing the coupling 250 from separating.

The coupling 250 coupled in this way has a clearance between the coupling 250 and the coupling binding portion 230 in a state coupled to the coupling binding portion 230, and a clearance range should be limited to a range that does not release engagement between the power transmission protrusion 210 of the rotation plate 200 and the protrusion receiving portion 320 of the hook body 300. This is because a clearance is so wide, and as the rotation plate 200 and the coupling separation prevention plate 260 recede together to the rear side along the power shaft of the sewing machine, when engagement between the power transmission protrusion 210 of the rotation plate 200 and the protrusion receiving portion 320 of the hook body 300 is released, torque of the power shaft is not transferred to the hook body 300. Further, due to such a clearance, because the coupling 250 and the coupling binding portion 230 performs a function similar to an universal joint, even if the power shaft of the sewing machine and the hook body 300 or a rotation shaft of the rotation plate 200 are not arranged in a straight line but deviated a little, power transfer can be smoothly performed. Therefore, when producing a product, a processing tolerance or an assembly tolerance can be further allowed and thus a production cost can be lowered and an assembly and processing time can be shortened.

As shown in FIG. 9 or 11, the hook body 300 is rotatably installed at the inside of the housing 100 and has a cylindrical shape having an opened front surface.

At the outside of a rear surface of the hook body 300, the protrusion receiving portion 320 that receives torque of the rotation plate 200 by engaging with the power transmission protrusion 210 of the rotation plate 200 is formed, and at the inside of a rear surface of the hook body 300, the bobbin mounting post 330 is formed.

As shown in FIG. 9 or 11, at an outer circumferential surface of the hook body 300, the hook 310 that pulls the upper thread by passing through a ring formed by the upper thread moved downward along the needle of the sewing machine is attached.

In a state in which the power transmission protrusion 210 of the rotation plate 200 and the protrusion receiving portion 320 of the hook body 300 are engaged, when the rotation plate 200 rotates, the hook body 300 rotates with the same rotation speed as that of the rotation plate 200 by interlocking with the rotation plate 200, and a clearance for discharging the upper thread should be defined between the power transmission protrusion 210 and the protrusion receiving portion 320.

As shown in FIG. 10 or 11, a lower thread guide A 340 starts from a direction opposite to the hook 310 of the hook body 300, is extended to be separated from the hook 310, and is positioned at the front side of the hook body 300, and the lower thread guide A 340 performs a function of maintaining a gap so that a lower thread supplied from the bobbin 400 does not meet with the hook 310.

As shown in FIG. 11, at an outer circumferential surface of the hook body 300, when the hook 310 moves while pulling the upper thread, an upper thread guide 380 that guides the upper thread to easily revolve a rear surface of the hook body 300 is formed.

At an outer circumferential surface of the front end of the hook body 300, the hook body guide rail A 360 that is housed at space between the hook body guide groove A 150 and the hook body separation prevention ring 160 and that performs a rotation movement is protruded to guide a stable rotation of the hook body 300.

As shown in FIGS. 9 to 11, at an outer circumferential surface of the hook body 300, a light transmission device 370 penetrated to correspond to the sensor mounting device 170 of the housing 100 is provided.

In the light transmission device 370, the bar code sensor 620 installed at the sensor mounting device 170 while performing a passage function of light of the light source unit 630 radiated to recognize the optical sensor 660 or the bar code 610 mounted in the bobbin 400 performs a function of an opened window for sensing the bar code 610 attached to the bobbin 400.

As shown in FIG. 9 or 11, the bobbin 400 has the same structure as that of a general spool in which the lower thread is wound and are formed with the rotation shaft 410 and the flange 420 provided at end portions of both sides of the rotation shaft 410, and in some case, a form having no flange 420 may be used. As shown in FIG. 9 or 11, the rotation shaft 410 of the bobbin 400 is rotatably inserted into the bobbin mounting post 330 of the hook body 300.

As shown in FIG. 12A, the bar code 610 is attached toward the center along an inner side surface of the flange 420 of the bobbin 400, and a plurality of position information according to a radius of the flange 420 is stored at the bar code 610. That is, at the bar code 610 attached toward the rotation shaft 410 from the outside of the flange 420, a plurality of position information that notifies a radius of the flange 420 is stored.

In the bar code 610, an one-dimensional bar code formed with a line or a two-dimensional bar code formed with a surface may be used, and a line or a surface constituting the bar code may use fluorescence dyes. A color bar code printed with various colors and widths may be used.

Therefore, by sensing the bar code 610 exposed by unwinding of the lower thread, a present remaining amount of the lower thread can be easily detected.

The bar code sensor 620 is installed in the sensor mounting device 170 of the housing 100 to sense the bar code 610, thereby performing a function of detecting the remaining amount of the lower thread, and such a bar code sensor 620 is formed with a bar code detection sensor, which is a kind of an optical sensor, and as a color bar code, an existing color sensor or a CMOS sensor may be used. Further, in the bar code sensor 620, it is preferable that the light source units 630 formed with a lighting device such as an LED that radiates light toward the bobbin 400 are installed in parallel to enable the bar code sensor 620 to smoothly sense.

As shown in FIG. 12A, the bar code sensor 620 is connected to a controller 700, and the controller 700 includes a decoder 710, a setting unit 730, and a processor 720.

A bar code value sensed in the bar code sensor 620 is converted to a digital value in the decoder 710, and the processor 720 compares the converted digital value and a reference value that is preset in the setting unit 730. As a comparison result, in order to represent a signal according to the remaining amount of the lower thread to the outside, a speaker or a light emitting means (signal lamp) may be used. For example, a green lamp, a yellow lamp, and a red lamp are connected to the controller 700, and when the remaining amount of the lower thread is enough, the green lamp may be set to be turned on, and as the remaining amount of the lower thread is gradually reduced, when the remaining amount of the lower thread arrives at a preset first warning time point, the yellow lamp may be set to be turned on, and as the remaining amount of the lower thread is extremely reduced, when the remaining amount of the lower thread arrives at a preset time point in which replacement is necessary, the red lamp may be set to be turned on. Further, even when a constant time has elapsed after the red lamp is turned on, if the lower thread is not replaced, a driving motor of the sewing machine may be set to be stopped. Even when a speaker is used, similarly, by generating a previously stored voice or sound signal according to a level, the remaining amount of the lower thread may be notified to a user.

As shown in FIG. 12B, the bar code 610 may be attached in a direction parallel to the rotation shaft 410 along an outer circumferential surface of the rotation shaft 410 of the bobbin 400, and in this case, a plurality of position information according to a region of the rotation shaft 410 is stored.

In this way, when the bar code 610 is attached along an outer circumferential surface of the rotation shaft 410 of the bobbin 400, the lower thread should be sequentially wound according to a region of the rotation shaft 410. For example, as shown in FIG. 8B, the rotation shaft 410 is divided into regions a, b, and c, and first, the lower thread is wound to only the region a, thereafter, the lower thread is wound to only the region b, and thereafter, the lower thread is wound to only the region c, and as the lower thread is consumed, the region c is first exposed and thus the bar code 610 of a corresponding portion may be sensed and the region b and the region a are sequentially exposed, and the bar code 610 of a corresponding portion may be sensed. Therefore, as described above, a warning signal may occur at an appropriate time point according to a preset value.

Figure 13:
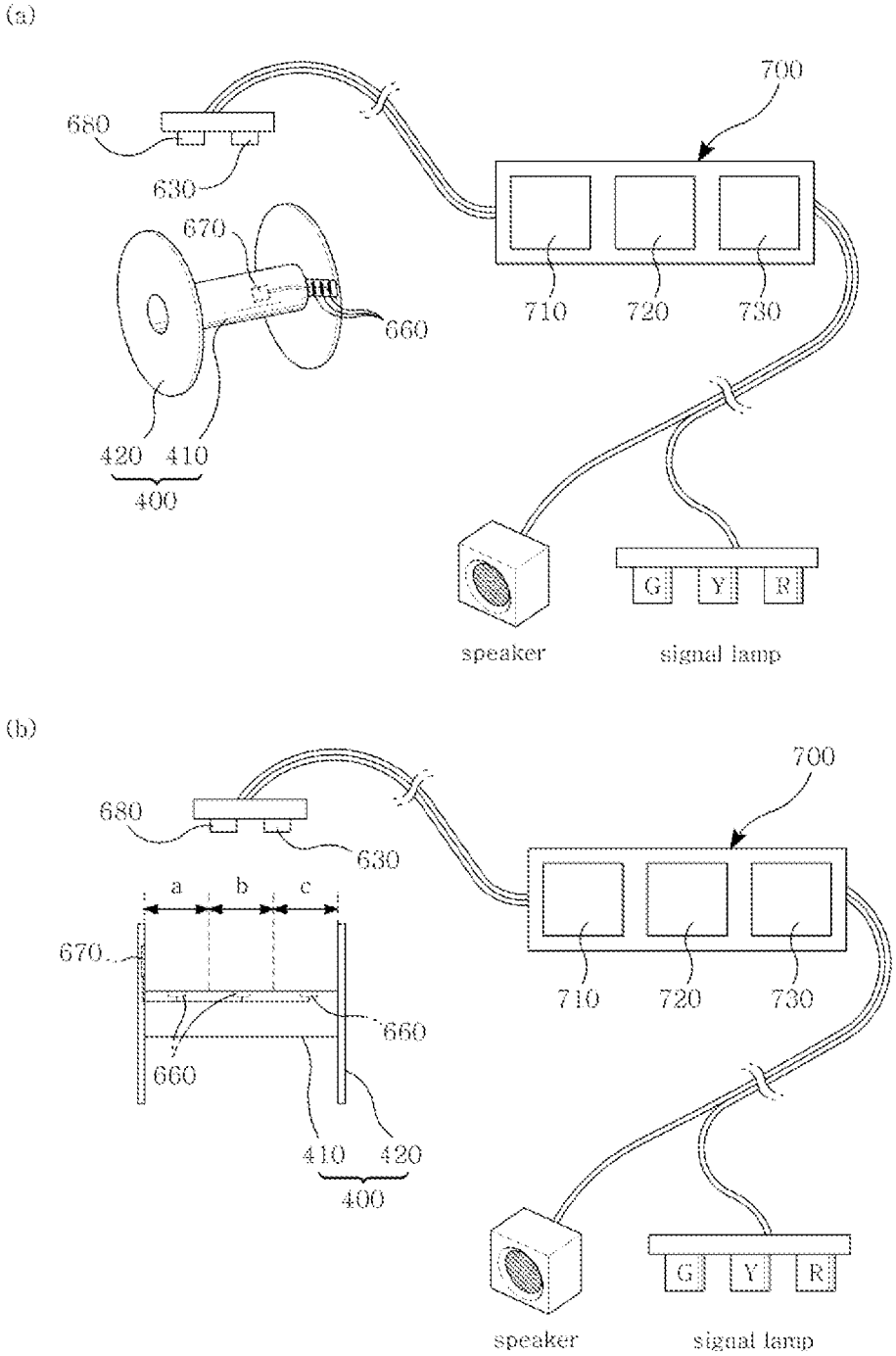
FIG. 13A illustrates a case where an optical sensor 660 is attached to a flange 420 of a bobbin 400.
FIG. 13B illustrates a case where an optical sensor 660 is attached to a rotation shaft 410 of a bobbin 400.

FIG. 13 illustrates an exemplary embodiment using an optical sensor 660, an RFID tag 670, and an RFID reader 680 instead of a bar code.

In FIG. 13A, the optical sensors 660 are separately installed toward the center along an inner side surface of the flange 420 of the bobbin 400. This is, the optical sensor 660 are separately installed to position at different radiuses along an inner side surface of the flange 420, and in this way, as the optical sensors 660 are installed to position at different radiuses, the optical sensor 660 can detect the remaining amount of the lower thread according to a signal transmitted from each optical sensor 660.

The RFID tag 670 is connected to the optical sensor 660 to perform a function of transmitting a signal transferred from each optical sensor 660.

As shown in FIG. 13A, the RFID reader 680 may be installed in the sensor mounting device 170, but an installation position of the RFID reader 680 is not limited thereto and the RFID reader 680 can be installed at any position that can receive a signal of the RFID tag 670. The RFID reader 680 receives a signal transmitted from the RFID tag 670 and determines whether the signal is a signal transmitted from the optical sensor 660 installed at any position of the flange 420 and detects the remaining amount of the lower thread wound in the bobbin 400.

As shown in FIG. 13A, the RFID reader 680 is connected to the controller 700, and the controller 700 includes a decoder 710, a setting unit 730, and a processor 720, and as the lower thread is consumed, the controller 700 detects the remaining amount of the lower thread according to a signal transferred from the sequentially exposed optical sensor 660, compares the remaining amount with a preset reference value, and may occur a warning signal through a speaker or a light emitting means (lamp) at an appropriate time point, and this is the same as a case of FIG. 12A and therefore a detailed description thereof will be omitted.

In FIG. 12B, similar to that the bar code 610 is installed at the rotation shaft 410 of the bobbin 400, in FIG. 13B, the optical sensor 660 is installed at a rotation shaft 410 of the bobbin 400.

In this case, similar to FIG. 12B, the lower thread should be wound with divided into regions, and similar to a method described in relation to FIG. 12B, the remaining amount of the lower thread is detected and may be warned to a user.

In FIG. 13, it is preferable that the light source unit 630 that is formed with a lighting device such as an LED that radiates light toward the bobbin 400 is installed in the sensor mounting device 170 of the housing 100 to enable the optical sensor 660 to smoothly sense.

In some case, the remaining amount of the lower thread wound in the bobbin 400 may be directly measured without installing a separate bar code or optical sensor in the bobbin 400.

That is, although separately not shown, by installing a laser distance measuring device in an attached portion of the bar code sensor 620 and the light source unit 630 and by measuring a distance to the lower thread wound in the bobbin 400, the remaining amount of the lower thread may be detected. As the lower thread is consumed, a distance between the laser distance measuring device and the lower thread increases, by measuring such a distance, a consumed amount of the lower thread and the present remaining amount of the lower thread can be calculated. Even when such a laser distance measuring device is used, operation performed in the controller 700, a speaker, and a signal lamp is the same as that shown in FIG. 12 or 13. In a configuration of the invention, in FIG. 12, a separate bar code 610 is not attached to the bobbin 400, and the bar code sensor 620 is replaced with a laser reception diode, and the light source unit 630 is replaced with a laser transmission diode.

As shown in FIGS. 9 to 11, the cap 500 is detachably coupled to the bobbin mounting post 330 by passing through the center of the bobbin 400 to prevent the bobbin from separating from the hook body 300.

The cap 500 is detachably coupled to the bobbin mounting post 330 through the cap detachment lever 550 and the clip 540, when pulling the cap detachment lever 550 to the front side, coupling between the clip 540 and the bobbin mounting post 330 is released, and thus the cap 500 may be separated, and in a state in which the bobbin 400 is mounted, when the cap 500 is pushed, binding between the clip 540 and the bobbin mounting post 330 is performed and thus the cap 500 is prevented from separating.

Although not separately shown in the accompanying drawings, at an inner side surface of the cap 500, an elastic body such as a flat spring that elastically supports one side surface of the bobbin 400 is further provided to control a rotation speed of the bobbin 400, thereby preventing the bobbin 400 from idling, and an existing lower thread supply device has a similar function due to such a structure and therefore a specific illustration or description thereof will be omitted.

As shown in FIG. 9 or 11, one side of the tension adjustment piece 510 is coupled to one side of the front side of the cap 500, and the other side thereof is inserted into the binding groove 350 formed in an inner circumferential surface of the hook body 300, and the tension adjustment piece 510 applies a constant tension to the lower thread that forms a stitch by meeting with the upper thread by appropriately pressing the lower thread unwound from the bobbin 400 with a constant elastic force together with a guide function of passing though the lower thread unwound from the bobbin 400. Further, in order to form a stitch, at the moment that the upper thread moves upward while pulling the lower thread, the tension adjustment piece 510 appropriately adjusts a speed in which the lower thread is unwound by resisting with an appropriate tension, thereby preventing a backlash phenomenon. In this way, in a state in which the tension adjustment piece 510 is inserted into the binding groove 350 formed in an inner circumferential surface of the hook body 300, the tension adjustment piece 510 has a structure coupled to one side of the front side of the cap 500 and thus performs a function of preventing a movement (lateral rotation) of the cap.

That is, the lower thread unwound from the bobbin 400 passes though the inside of the tension adjustment piece 510, and in this process, the tension adjustment piece 510 gently grasps the lower thread by an elastic force.

In the cap 500, the cap hole 520 that penetrates a central portion is formed, and at a side surface of the front side in which the tension adjustment piece 510 is mounted, the lower thread penetration hole A 530 communicating with the cap hole 520 is formed.

The lower thread, having passed through the tension adjustment piece 510 is discharged to the front side of the cap 500 by passing through the lower thread penetration hole A 530 and the cap hole 520, and the discharged lower thread moves upward and meets with the lower thread guide A 340, forms a stitch with the upper thread at a cloth, and a constant tension operates in the lower thread between the cloth and the cap hole 520 by a function of the tension adjustment piece 510, and the lower thread is thus in a somewhat pulled state, thereby smoothly forming a stitch with the upper thread.

FIG. 10 is an assembled complete view illustrating a specific embodiment of the present invention.

When the power shaft of the sewing machine rotates, the rotation plate 200 connected thereto rotates, and because the power transmission protrusion 210 of the rotation plate 200 and the protrusion receiving portion 320 of the hook body 300 are engaged, the hook body 300 rotates together with the rotation plate 200.

Further, because the cap 500 is in a state engaged with the hook body 300 by the tension adjustment piece 510, the cap 500 rotates together with the hook body 300.

When the hook 310 of the hook body 300 rotates while pulling the upper thread, the upper thread of a loop form winds a front-rear surface of the hook body 300. In this case, the upper thread winding a rear surface of the hook body 300 passes through space between the hook body 300 and the rotation plate 200, and a clearance for passing through the upper thread is formed between the power transmission protrusion 210 of the rotation plate 200 and the protrusion receiving portion 320 of the hook body 300. Further, the upper thread guide 120 performs a function of guiding the upper thread to well wind the front and rear surfaces of the hook body 300.

FIGS. 14 to 20 illustrate another specific embodiment of the present invention.

Figure 14:
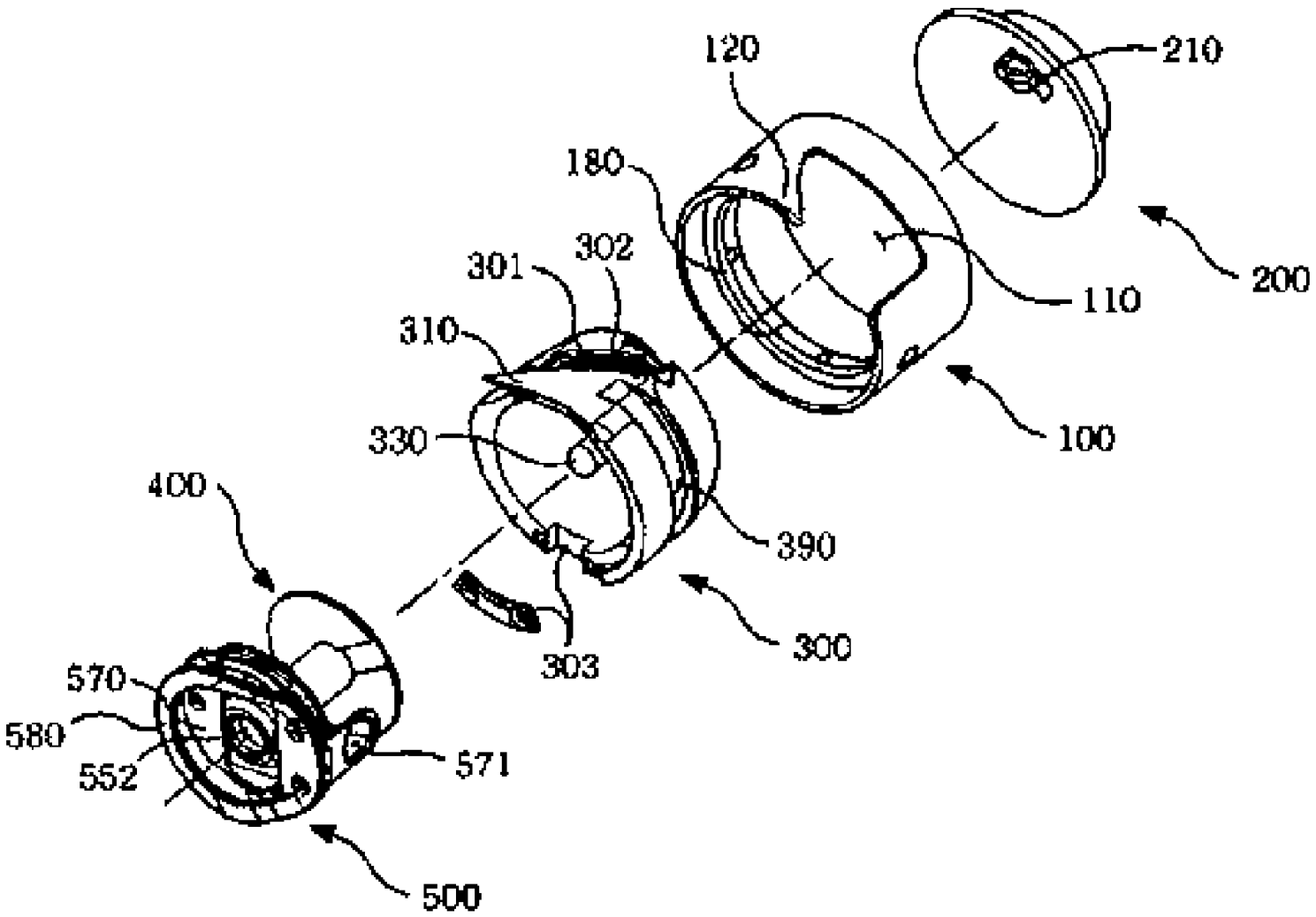
FIG. 14 is an exploded perspective view illustrating another specific embodiment of the present invention.
Figure 15:
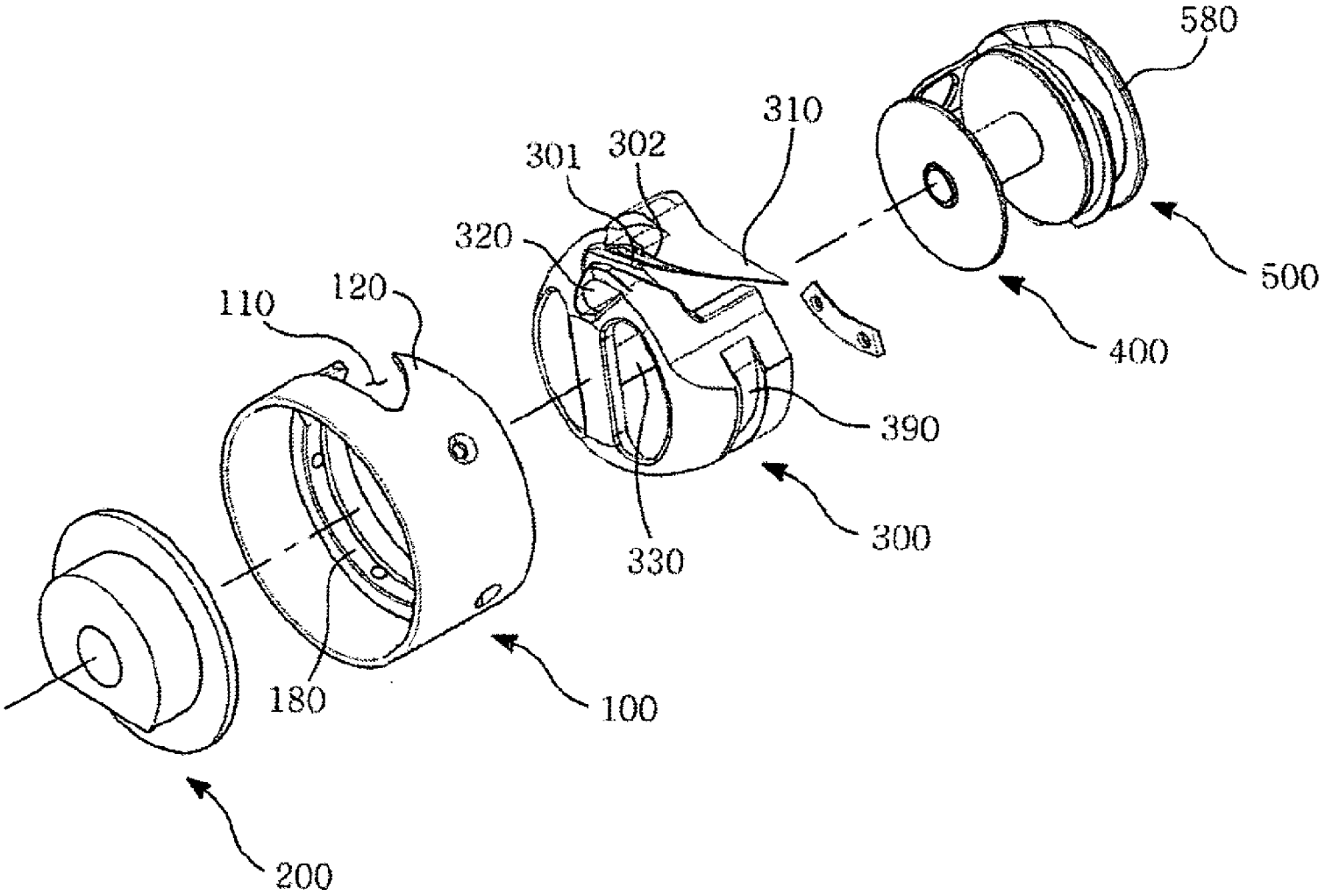
FIG. 15 is an exploded perspective view seen in a direction different from the exploded perspective view of FIG. 14.

FIG. 14 is an exploded perspective view illustrating another specific embodiment of the present invention, and FIG. 15 is an exploded perspective view seen in a direction different from the exploded perspective view of FIG. 14.

The housing 100 is fixed to a main body of the sewing machine and has a cylindrical pipe shape in which a front surface and a rear surface are opened along a central axis.

The housing 100 is fixed to a main body of the sewing machine using generally known various brackets, fixing volts, or pins, and a separate description thereof will be omitted. The housing 100 is fixed to the main body of the sewing machine, and even if the power shaft of the sewing machine rotates, the housing 100 does not rotate and maintains a fixed state.

An outer circumferential surface (portion in which a needle of the sewing machine moves downward) of one side of such a housing is cut out to form the housing cutout portion 110, and the housing cutout portion 110 provides space in which the upper thread moving downward in a loop form by being hooked by a needle is engaged to the hook 310.

That is, after the hook 310 attached to the hook body 300 rotating in the housing cutout portion 110 is engaged with the upper thread while passing through the upper thread of a loop form moved downward along a needle, the hook 310 rotates while pulling the upper thread.

The upper thread guide 120 is provided to be protruded in a direction opposite to the hook 310 at one side of the housing cutout portion 110 of the housing 100 and performs a function of guiding the upper thread to the rear side of the hook body 300 by hooking the upper thread forming a loop when the hook 310 rotates while pulling the upper thread.

The upper thread guide 120 may have a structure that assembles a separate part in the housing 100 and may be formed integrally with the housing 100.

At an inner side surface of the housing 100, a hook body guide rail B 180 that guides a rotation of the hook body 300 is protruded, and the hook body guide rail B 180 is housed in a hook body guide groove B 390 cut out along an outer circumferential surface of the hook body 300.

The rotation plate 200 is connected to the power shaft of the sewing machine, has a circular plate shape, and the power transmission protrusion 210 is formed at a front surface of a circular plate. The rotation plate 200 is installed at the rear end of the housing 100 to transfer torque to the hook body 300.

That is, in a state in which the power transmission protrusion 210 of the rotation plate 200 and the protrusion receiving portion 320 of the hook body 300 are engaged, when the rotation plate 200 is connected to the power shaft of the sewing machine for rotating, the hook body 300 rotates together by interlocking with the rotation plate 200.

In a state in which that the power transmission protrusion 210 of the rotation plate 200 and the protrusion receiving portion 320 of the hook body 300 are engaged, a clearance (gap) for discharging the upper thread exists between the power transmission protrusion 210 and the protrusion receiving portion 320. That is, the power transmission protrusion 210 and the protrusion receiving portion 320 rotate while engaging in a state in which some allowance space exists.

The hook body 300 is rotatably installed at the inside of the housing 100, and has a cylindrical shape having an opened front surface, and at the outside of a rear surface thereof, the protrusion receiving portion 320 that receives torque of the rotation plate 200 by being engaged with the power transmission protrusion 210 is formed.

At the inside of a rear surface of the hook body 300, the bobbin mounting post 330 is formed to perform a function of a rotation shaft of the bobbin 400.

The hook 310 is attached to an outer circumferential surface of one side of the hook body 300 and performs a function of pulling the upper thread while passing through a loop formed by the upper thread moved downward along a needle of the sewing machine.

A guide channel 301 depressed toward a rear surface of the hook body 300 along one side of an outer circumferential surface of the hook body 300 to which the hook 310 is attached to guide the upper thread to the rear side of the hook body 300 is provided, and a guide bank A 302 protruded parallel to the guide bank A 302 along one side of the guide channel 301 to guide the upper thread to the inside of the guide channel 301 is provided.

When the hook 310 rotates while pulling the upper thread by passing through a loop formed by the upper thread moved downward along the needle of the sewing machine, the upper thread guide 120 installed opposite to the hook 310 guides the upper thread to enter into the guide channel 301 while passing through a loop formed by the upper thread, and the guide bank A 302 performs a function of a blocking film that prevents the upper thread from being inserted into a gap between the hook body guide rail B 180 and the hook body guide groove B 390 by enabling the upper thread to pass through an upper portion of the guide channel 301 instead of entering into the guide channel 301.

At an outer circumferential surface of the hook body 300, a hook body guide groove B 390 that houses the hook body guide rail B 180 is cut out. The hook body guide rail B 180 and the hook body guide groove B 390 perform a function of guiding the hook body 300 to perform a stable rotation within the housing 100. Although not separately illustrated in the accompanying drawing, in some case, the hook body guide rail B 180 may be provided in an outer circumferential surface of the hook body 300, and the hook body guide groove B 390 may be provided at an inner side surface of the housing 100.

Figure 16:
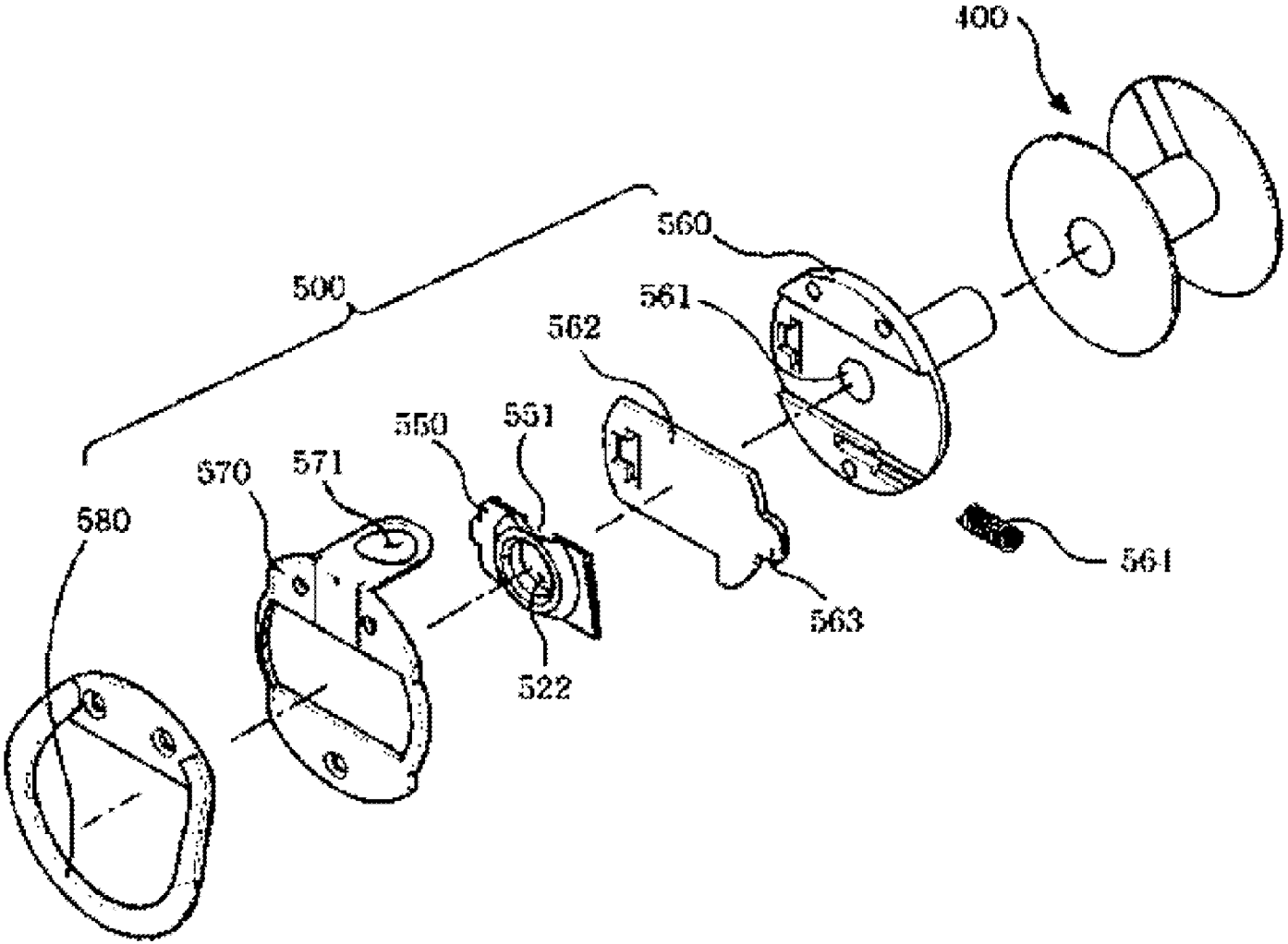
FIG. 16 is an exploded perspective view illustrating a coupling structure of a cap 500 and a bobbin 400.
Figure 17:
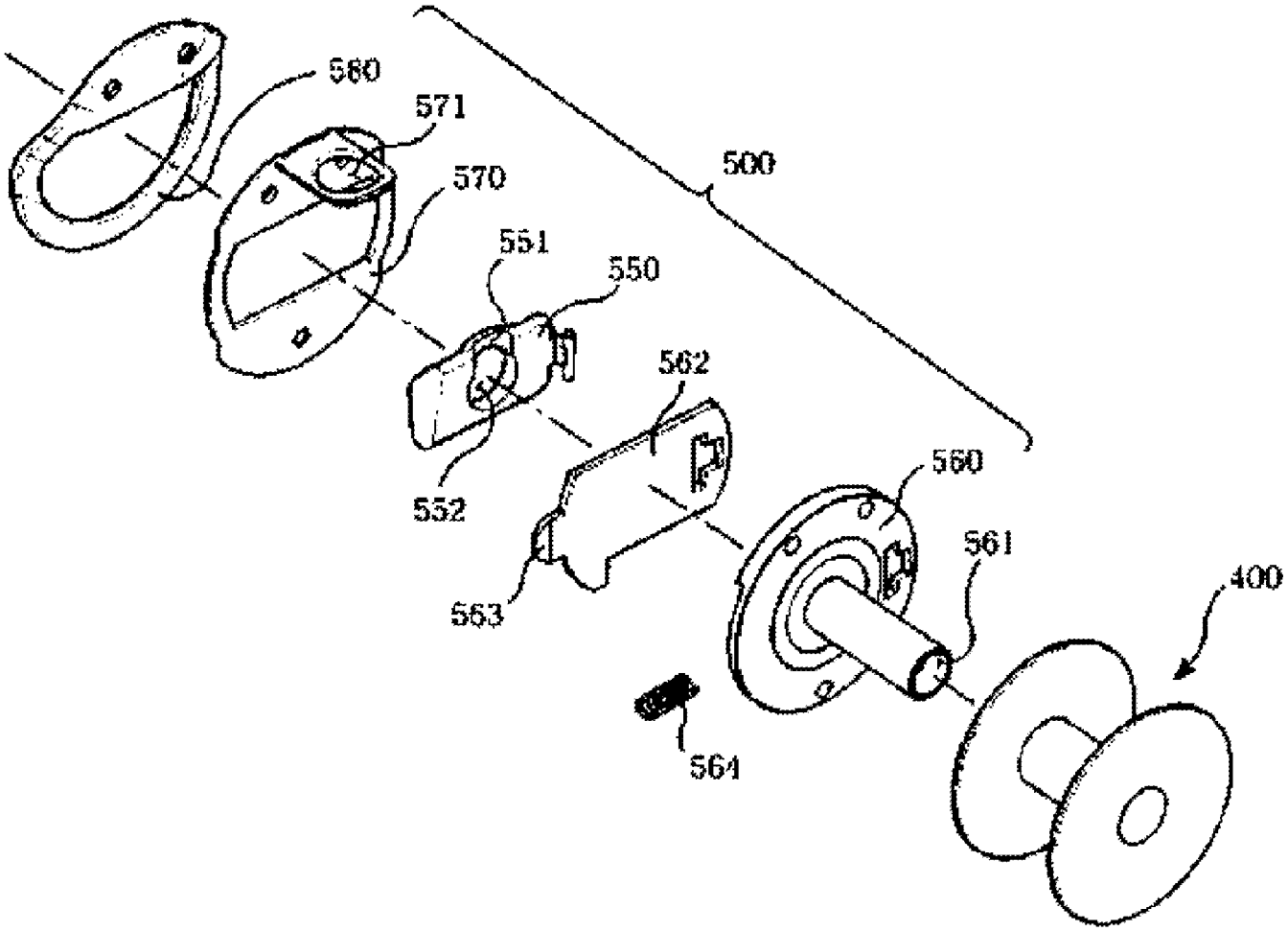
FIG. 17 is an exploded perspective view seen in a direction different from the exploded perspective view of FIG. 16.

FIG. 16 is an exploded perspective view illustrating a coupling structure of the cap 500 and the bobbin 400, and FIG. 17 is an exploded perspective view illustrating the coupling structure of FIG. 16 seen in a different direction.

The bobbin 400 is inserted into the bobbin mounting post 330 of the hook body 300 to be rotatably installed, and such a bobbin 400 has a spool shape in which a lower thread is wound like a bobbin of a general lower thread supply device.

The cap 500 is detachably coupled to the bobbin mounting post 330 by passing through the center of the bobbin 400 and performs a function of preventing the bobbin 400 from separating from the hook body 300.

A lower thread guide B 580 is coupled to a front surface of a outer cover 570, which is a front end portion of the cap 500 and is protruded to the front side further than a tip of the hook 310 to perform a function of maintaining a gap so that the lower thread supplied from the bobbin 400 does not meet with the hook 310.

The cap 500 includes an inner cover 560, a separation prevention piece 562, a cap detachment lever 550, a spring 564, and an outer cover 570.

In the inner cover 560, a mounting post receiving hole 561 coupled to the bobbin mounting post 330 of the hook body 300 by passing through the bobbin 400 is long provided and becomes a portion directly contacting with the bobbin 400.

As shown in FIG. 16, in such an inner cover 560, in a front end portion of a post portion having the mounting post receiving hole 561, a cover of a circular plate form is provided.

The separation prevention piece 562 is slidably coupled to a front surface of the inner cover 560.

A separation prevention protrusion 563 formed in an end portion of one side of the separation prevention piece 562 is housed in a separation prevention piece receiving portion 303 provided at one side of a front end portion of the hook body 300, and in this way, when the separation prevention protrusion 563 is inserted into the separation prevention piece receiving portion 303 of the hook body 300, the separation prevention protrusion 563 prevents the cap 500 from separating and resultantly enables the bobbin 400 to stably stay within the hook body 300.

The spring 564 is installed in the inner cover 560 and elastically supports the separation prevention piece 562, and pushes the separation prevention piece 562 in a direction of the separation prevention piece receiving portion 303 in order to maintain a state in which the separation prevention protrusion 563 is housed in the separation prevention piece receiving portion 303 of the hook body 300.

The cap detachment lever 550 is rotatably coupled to a front surface of the separation prevention piece 562, and when the cap detachment lever 550 rotates to the front side, the cap detachment lever 550 pushes the separation prevention piece 562 so that the separation prevention protrusion 563 discharges from the separation prevention piece receiving portion 303. When the cap detachment lever 550 is released, the separation prevention piece 562 and the cap detachment lever 550 are returned to an original position by operation of the spring 564.

As shown in FIG. 16, in the cap detachment lever 550, at one side of the same direction as that of a lower thread penetration hole B 571 of the outer cover 570, the passage gap 551 that passes through a lower thread discharged from the lower thread penetration hole B 571 is provided, and in a central portion thereof, a lower thread discharge hole 552 that discharges the lower thread entered to the center of the cap detachment lever 550 by passing through the passage gap 551 is provided.

The outer cover 570 is positioned at a front surface of the cap detachment lever 550 and is coupled to the inner cover 560.

The cap detachment lever 550 and the separation prevention piece 562 are installed between the outer cover 570 and the inner cover 560, and a central portion of the outer cover 570 is opened to be protruded to the front side by rotating the cap detachment lever 550.

Further, at one side extended toward the bobbin 400 from the outer cover 570, the lower thread penetration hole B 571 that discharges the lower thread unwound from the bobbin 400 is provided.

Figure 18:
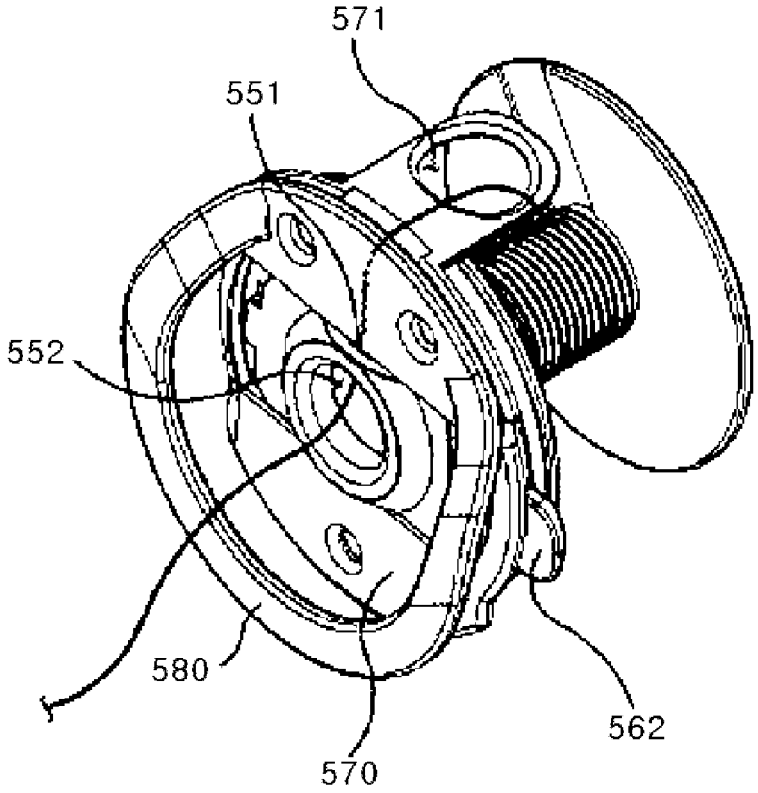
FIG. 18 illustrates a discharge path of a lower thread unwound from a bobbin 400.

FIG. 18 illustrates a discharge path of a lower thread unwound from the bobbin 400. The lower thread unwound from the bobbin 400 is discharged to the outside of the cap 500 through the lower thread penetration hole B 571 of the outer cover 570, and enters again to the center of the cap detachment lever 550 through the passage gap 551 of the cap detachment lever 550. The lower thread entered to the center of the cap detachment lever 550 in this way is discharged through the lower thread discharge hole 552 provided in the cap detachment lever 550 and meets with the upper thread in which the hook 310 pulls to form a stitch.

Figure 19:
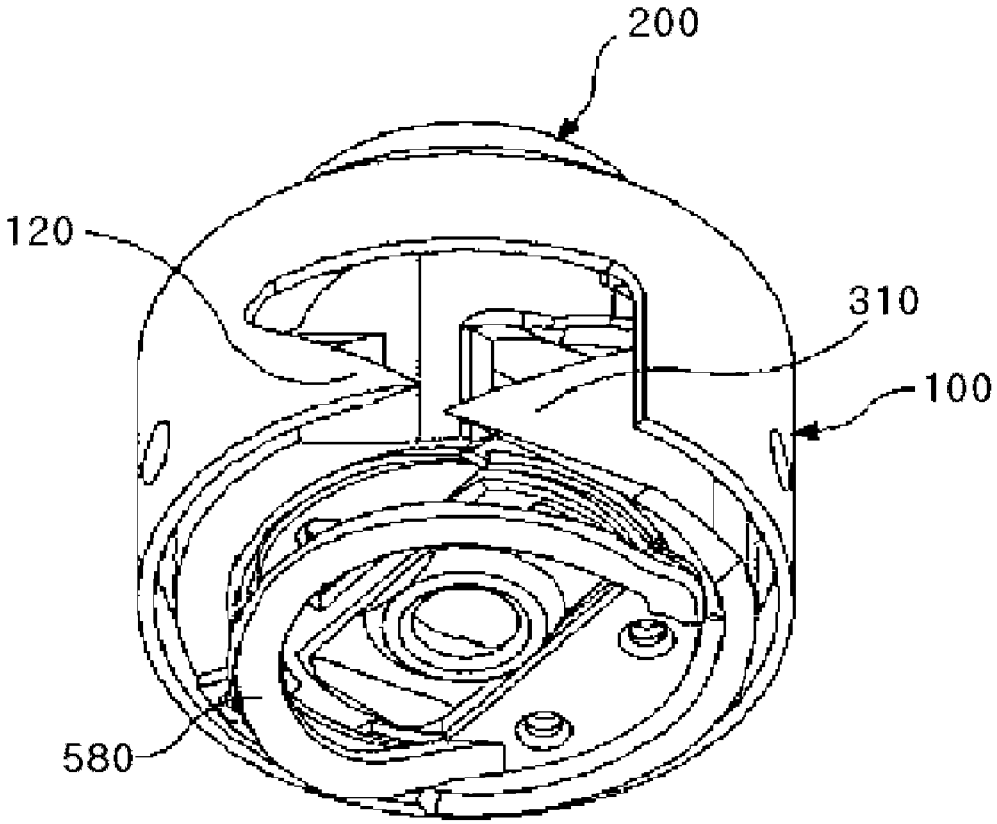
FIG. 19 is an assembled perspective view illustrating an assembled state of elements of the exemplary embodiment shown in FIG. 14.
Figure 20:
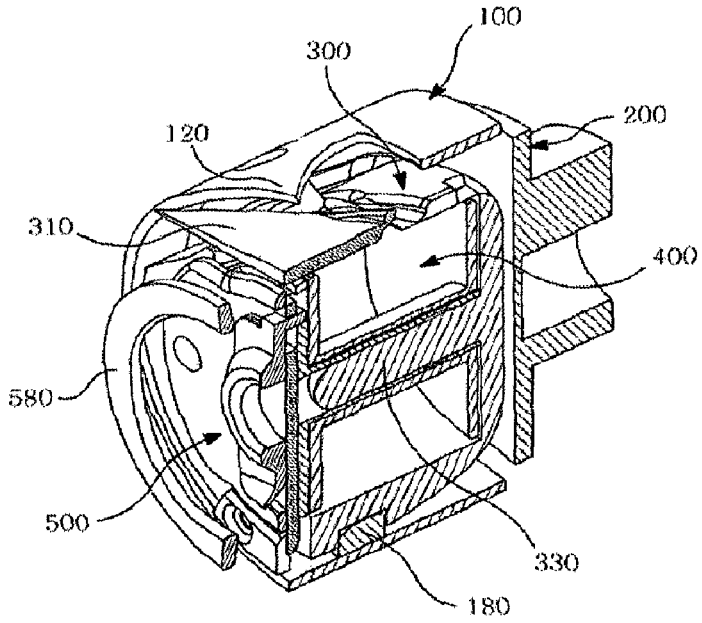
FIG. 20 illustrates a cross-sectional structure of an assembled state of elements of the exemplary embodiment shown in FIG. 14.
Figure 21:
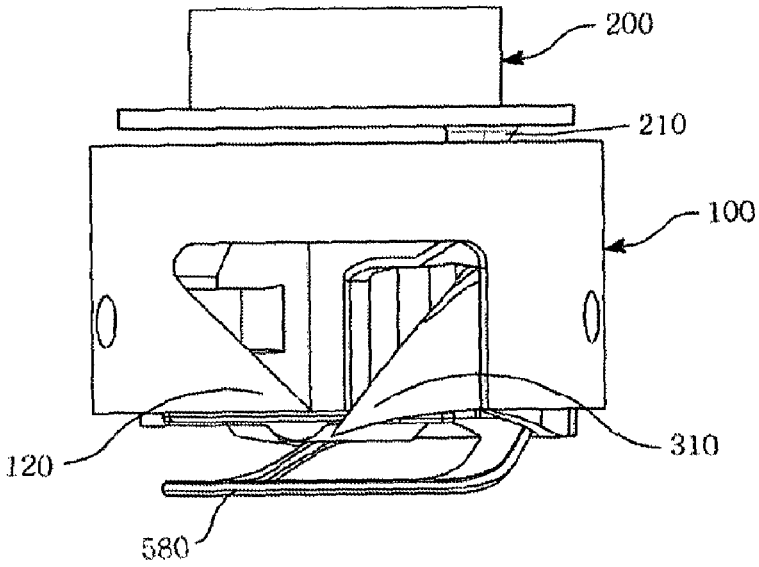
FIG. 21 is a top plan view illustrating an external form of an assembled state of the exemplary embodiment shown in FIG. 14.

FIG. 19 is an assembled perspective view illustrating an assembled state of elements of an exemplary embodiment shown in FIG. 14 and illustrates an entire external shape, and FIG. 20 illustrates a cross-sectional structure of an assembled state of elements of an exemplary embodiment shown in FIG. 14 and illustrates a coupling relation of constituent elements in which assembly is complete.

Figure 22:
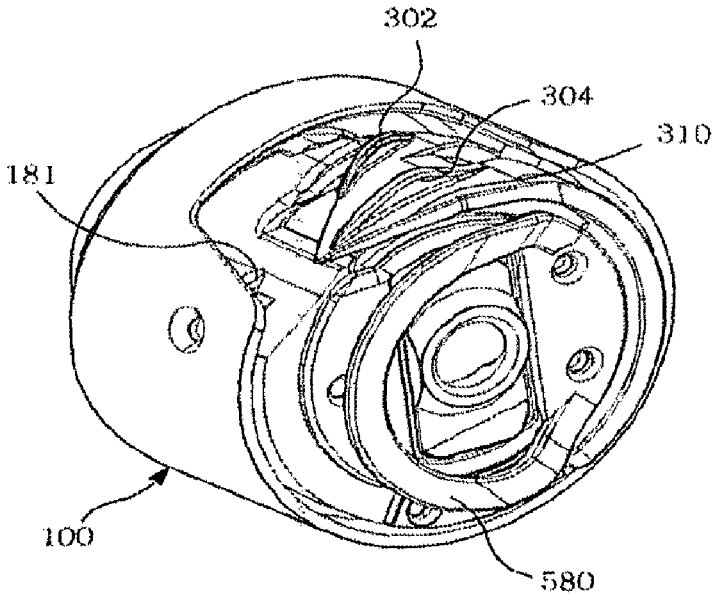
FIG. 22 is an assembled perspective view of another specific embodiment of the present invention illustrating a case where a rail hook 181 and a guide bank B 304 are additionally provided instead of an upper thread guide 120, unlike a case of FIG. 19.
Figure 23:
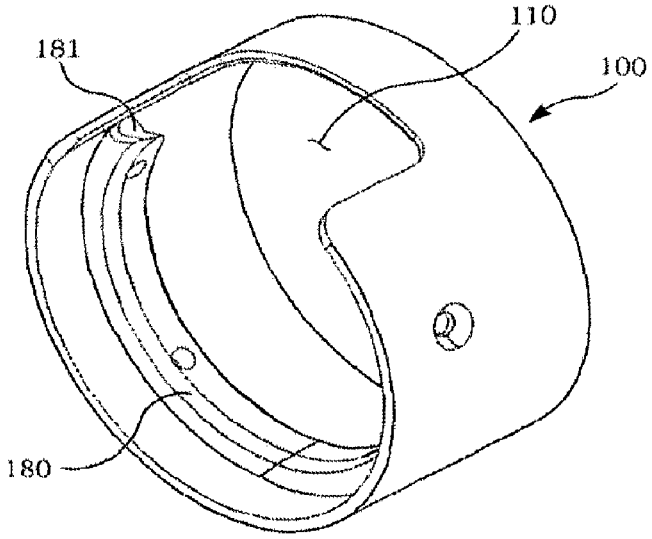
FIG. 23 is a perspective view illustrating a structure of a housing 100 and a hook body guide rail B 180 used in the exemplary embodiment of FIG. 22.
Figure 24:
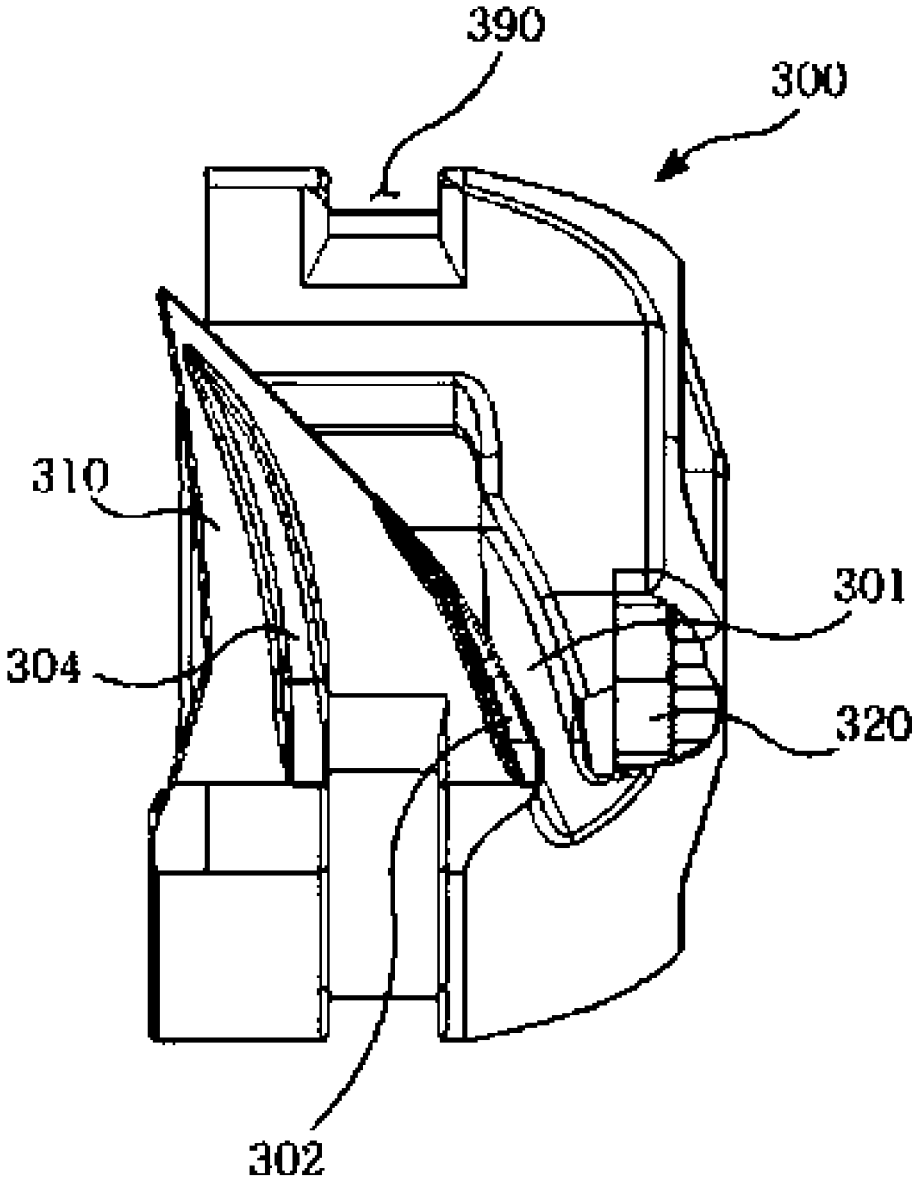
FIG. 24 illustrates a side structure of a hook body 300 used in the exemplary embodiment of FIG. 22.

FIG. 22 is an assembled perspective view illustrating another specific embodiment of the present invention illustrating a case where a rail hook 181 and the guide bank B 304 are additionally provided instead of the upper thread guide 120, unlike a case of FIG. 19, FIG. 23 is a perspective view illustrating a structure of the housing 100 and the hook body guide rail B 180 used in the exemplary embodiment of FIG. 22, and FIG. 24 illustrates a side structure of the hook body 300 used in the exemplary embodiment of FIG. 22.

Here, as shown in FIG. 22 or 23, in an end portion of one side of the hook body guide rail B 180 opposite to the hook 310, the rail hook 181 is protruded toward the hook 310, and when the hook 310 pulls the upper thread, the rail hook 181 enables the upper thread at an upper surface of the hook 310 to be hooked, similar to the upper thread guide 120, thereby performing a function of assisting the upper thread to smoothly move to a rear tilt end surface of the hook body 300.

As shown in FIG. 22 or 24, the guide bank B 304 is protruded from a tip of the hook 310 and performs a function of guiding the upper thread pulled by the hook 310 to be hooked to the rail hook 181. That is, the guide bank B 304 appropriately raises the upper thread pulled by the hook 310 and enables the upper thread to be hooked to the rail hook 181.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

DESCRIPTION OF SYMBOLS

100: housing
110: housing cutout portion
120: upper thread guide
121: upper thread guide groove
130: rotation plate guide groove
140: rotation plate separation prevention ring
150: hook body guide groove A
160: hook body separation prevention ring
170: sensor mounting device
180: hook body guide rail B
181: rail hook
200: rotation plate
210: power transmission protrusion
220: rotation plate guide rail
230: coupling binding portion
240: power shaft binding hole
250: coupling
260: coupling separation prevention plate
300: hook body
301: guide channel
302: guide bank A
303: separation prevention piece receiving portion
304: guide bank B
310: hook
320: protrusion receiving portion
330: bobbin mounting post
340: lower thread guide A
350: binding groove
360: hook body guide rail A
370: light transmission device
380: upper thread guide
390: hook body guide groove B
400: bobbin
410: rotation shaft
420: flange
500: cap
510: tension adjustment piece
520: cap hole
530: lower thread penetration hole A
540: clip
550: cap detachment lever
551: passage gap
552: lower thread discharge hole
560: inner cover
561: mounting post receiving hole
562: separation prevention piece
563: separation prevention protrusion
564: spring
570: outer cover
571: lower thread penetration hole B
580: lower thread guide B
610: bar code
620: bar code sensor
630: light source unit
660: optical sensor
670: RFID tag
680: RFID reader
700: controller
710: decoder
720: processor
730: setting unit

The invention claimed is:

1. A lower thread supply device for supplying a lower thread of a sewing machine, the lower thread supply device comprising:

a housing 100 that is fixed to a main body of the sewing machine and that has a cylindrical pipe shape in which a front surface and a rear surface are opened along a central axis and in which an outer circumferential surface of one side is cut out to form a housing cutout portion 110;

a rotation plate 200 that is connected to a power shaft of the sewing machine and that has a circular plate shape and that has a power transmission protrusion 210 at a front surface of the circular plate and that is installed at the rear end of the housing 100 for rotating;

a hook body 300 that is rotatably installed at the inside of the housing 100 and that has a front surface of an opened cylindrical shape and that has a protrusion receiving portion 320 that is engaged with the power transmission protrusion 210 to receive torque of the rotation plate 200 and that has a bobbin mounting post 330 and that has a hook 310 for pulling an upper thread by passing through a loop formed by the upper thread moved downward along a needle of the sewing machine at an outer circumferential surface of one side;

a bobbin 400 that is inserted into the bobbin mounting post 330 of the hook body 300 to be rotatably installed and that has a spool shape in which the lower thread is wound; and a cap 500 that passes through the center of the bobbin 400 and that is detachably coupled to the bobbin mounting post 330 to prevent the bobbin from separating from the hook body 300.

2. The lower thread supply device of claim 1, further comprising an upper thread guide 120 that is installed in a direction opposite to the hook 310 at one side of a housing cutout portion 110 of the housing 100 and that is provided at both sides of the upper thread guide groove 121 in which both sides of the upper thread forming a loop are housed when the hook 310 rotates while pulling the upper thread.

3. The lower thread supply device of claim 1, further comprising a lower thread guide A 340 that starts from a direction opposite to the hook 310 of the hook body 300 and that is separately extended from the hook 310 and that is positioned at the front side of the hook body 300 and that maintains a gap so that the lower thread supplied from the bobbin 400 does not meet with the hook 310.

4. The lower thread supply device of claim 1, further comprising a tension adjustment piece 510 that has one side coupled to one side of the front side of the cap 500 and the other side inserted into a binding groove 350 formed at an inner circumferential surface of the hook body 300 and that functions as a guide for passing through the lower thread unwound from the bobbin 400 and that presses the lower thread unwound from the bobbin 400 with a constant elastic force.

5. The lower thread supply device of claim 4, wherein the cap 500 comprises:

a cap hole 520 that penetrates a central portion of the cap 500; and a lower thread penetration hole A 530 that communicates with the cap hole 520 at a front side surface in which the tension adjustment piece 510 is mounted, wherein the lower thread, having passed through the tension adjustment piece 510 is discharged from the front side of the cap 500 by passing though the lower thread penetration hole A 530 and the cap hole 520.

6. The lower thread supply device of claim 1, wherein the housing 100 comprises:

a rotation plate guide groove 130 that has a shape of a single jaw formed along an inner side surface of the rear end of the housing 100 and that guides a rotation movement of the rotation plate 200; and a rotation plate separation prevention ring 140 that has a circular ring shape and that is coupled to a rear end portion of the housing 100 to prevent the rotation plate 200 from separating, wherein the rotation plate 200 comprises:

a rotation plate guide rail 220 that is protruded along an outer diameter and that is housed at space between the rotation plate guide groove 130 and the rotation plate separation prevention ring 140 to perform a rotation movement.

7. The lower thread supply device of claim 1, wherein the housing 100 comprises:

a hook body guide groove A 150 that has a shape of a single jaw formed along an inner side surface of the front end of the housing 100 and that guides a rotation movement of the hook body 300; and a hook body separation prevention ring 160 that has a shape in which a partial area corresponding to the housing cutout portion 110 is cut out in a circular ring and that is coupled to a front end portion of the housing 100 to prevent the hook body 300 from separating, wherein the hook body 300 comprises:

a hook body guide rail A 360 that is protruded along an outer circumferential surface of the front end and that is housed at space between the hook body guide groove A 150 and the hook body separation prevention ring 160 to perform a rotation movement.

8. The lower thread supply device of claim 1, wherein in a state in which the power transmission protrusion 210 of the rotation plate 200 and the protrusion receiving portion 320 of the hook body 300 are engaged, a clearance for discharging the upper thread is secured between the power transmission protrusion 210 and the protrusion receiving portion 320.

9. The lower thread supply device of claim 1, wherein the rotation plate 200 comprises:

a coupling binding portion 230 that is protruded from a rear surface of a circular plate to maintain a constant gap;

a coupling 250 having a power shaft binding hole 240 that inserts and couples a power shaft of the sewing machine at the center and that is radially extended about the power shaft binding hole 240 to be housed to space between the coupling binding portion 230; and a coupling separation prevention plate 260 having a hollow that passes through the power shaft of the sewing machine passes at the center and that is coupled to a rear end surface of the coupling binding portion 230 to prevent the coupling 250 from separating, wherein the coupling 250 secures a clearance in the front-rear direction in a state coupled to the coupling binding portion 230, and a range of the clearance is limited to a range that does not release engagement between the power transmission protrusion 210 of the rotation plate 200 and the protrusion receiving portion 320 of the hook body 300.

10. The lower thread supply device of claim 1, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a bar code 610 that is attached toward the center along an inner side surface of the flange 420 of the bobbin 400 and in which a plurality of position information is stored according to a radius of the flange 420; and a bar code sensor 620 that is installed at the sensor mounting device 170 of the housing 100 to sense the bar code 610 and to detect the remaining amount of the lower thread.

11. The lower thread supply device of claim 1, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of the rotation shaft 410, the lower thread supply device further comprises:

a bar code 610 that is attached in a direction parallel to the rotation shaft 410 along an outer circumferential surface of the rotation shaft 410 of the bobbin 400 and in which a plurality of position information is stored according to a region of the rotation shaft 410; and a bar code sensor 620 that is installed at the sensor mounting device 170 of the housing 100 to sense the bar code 610 and to detect the remaining amount of the lower thread.

12. The lower thread supply device of claim 1, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a plurality of optical sensors 660 that are separately installed toward the center along an inner side surface of the flange 420 of the bobbin 400;

an RFID tag 670 that is connected to the optical sensor 660 to transmit a signal transferred from each optical sensor 660; and an RFID reader 680 that receives a signal transmitted from the RFID tag 670 and that determines whether the signal is a signal transmitted from the optical sensor 660 installed at any position of the flange 420 and that detects the remaining amount of the lower thread wound in the bobbin 400.

13. The lower thread supply device of claim 1, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of a rotation shaft 410, the lower thread supply device further comprises:

a plurality of optical sensors 660 that are separately installed in a direction parallel to the rotation shaft 410 along an outer circumferential surface of the rotation shaft 410 of the bobbin 400;

an RFID tag 670 that is connected to the optical sensor 660 to transmit a signal transferred from each optical sensor 660; and an RFID reader 680 that receives the signal transmitted from the RFID tag 670 and that determines whether the signal is a signal transmitted from the optical sensor 660 installed at any position of the rotation shaft 410 and that detects the remaining amount of the lower thread wound in the bobbin 400.

14. The lower thread supply device of claim 1, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of a rotation shaft 410, the lower thread supply device further comprises:

a laser distance measuring device (not shown) that is installed in the sensor mounting device 170 of the housing 100 to detect the remaining amount of the lower thread by sensing a distance to a surface of the lower thread wound in the bobbin 400.

15. The lower thread supply device of claim 1, further comprising an upper thread guide 120 that is provided to be protruded in a direction opposite to the hook 310 at one side of the housing cutout portion 110 of the housing 100 and that guides the rear side of the hook body 300 by hooking the upper thread that forms a loop when the hook 310 rotates while pulling the upper thread.

16. The lower thread supply device of claim 1, further comprising a lower thread guide B 580 that is coupled to a front end portion of the cap 500 and that is protruded to the front side further than a tip of the hook 310 to maintain a gap so that the lower thread supplied from the bobbin 400 does not meet the hook 310.

17. The lower thread supply device of claim 1, wherein the cap 500 comprises:

an inner cover 560 having a mounting post receiving hole 561 coupled to the bobbin mounting post 330 of the hook body 300 by passing through the bobbin 400;

a separation prevention piece 562 that is slidably coupled to a front surface of the inner cover 560 and in which the separation prevention protrusion 563 formed in an end portion of one side is housed in a separation prevention piece receiving portion 303 provided at one side of a front end portion of the hook body 300;

a spring 564 that is installed in the inner cover 560 and that elastically supports the separation prevention piece 562 to enable the separation prevention protrusion 563 to maintain a state housed in the separation prevention piece receiving portion 303;

a cap detachment lever 550 that is rotatably coupled to a front surface of the separation prevention piece 562 and that pulls the separation prevention piece 562 so that the separation prevention protrusion 563 escapes from the separation prevention piece receiving portion 303 when the cap detachment lever 550 rotates to be protruded to the front side; and an outer cover 570 that is positioned at a front surface of the cap detachment lever 550 and that is coupled to the inner cover 560 to receive the cap detachment lever 550 and the separation prevention piece 562 and that has an opened central portion so that the cap detachment lever 550 rotates to protrude to the front side and that has a lower thread penetration hole B 571 that discharges the lower thread unwound from the bobbin 400 at one side extended toward the bobbin 400.

18. The lower thread supply device of claim 17, wherein the cap detachment lever 550 comprises:

a passage gap 551 through which the lower thread, having discharged the lower thread penetration hole B 571 passes at one side of the same direction as that of the lower thread penetration hole B 571 of the outer cover 570; and a lower thread discharge hole 552 that discharges the lower thread injected to the center of the cap detachment lever 550 through the passage gap 551 at a central portion.

19. The lower thread supply device of claim 1, further comprising:

a hook body guide rail B 180 that is protruded along an inner side surface of the housing 100 to guide a rotation of the hook body 300; and a hook body guide groove B 390 that is cut out along an outer circumferential surface of the hook body 300 to house the hook body guide rail B 180.

20. The lower thread supply device of claim 1, wherein the hook body 300 comprises:

a guide channel 301 that is depressed toward the rear side of the hook body 300 along one side of an outer circumferential surface to which the hook 310 is attached to guide the upper thread to the rear side of the hook body 300; and a guide bank A 302 that is protruded parallel to one side of the guide channel 301 to guide the upper thread to the inside of the guide channel 301.

21. The lower thread supply device of claim 19, wherein in an end portion of one side of the hook body guide rail B 180 opposite to the hook 310, a rail hook 181 protruded toward the hook 310 is provided, and when the hook 310 rotates while pulling the upper thread, the rail hook 181 hooks the upper thread forming a loop to guide the upper thread to the rear side of the hook body 300, wherein the hook body 300 comprises:

a guide channel 301 that is depressed toward the rear side of the hook body 300 along one side of an outer circumferential surface to which the hook 310 is attached to guide the upper thread to the rear side of the hook body 300;

a guide bank A 302 that is protruded parallel to one side of the guide channel 301 to guide the upper thread to the inside of the guide channel 301; and a guide bank B 304 that is protruded from a tip of the hook 310 to guide the upper thread pulled by the hook 310 to be hooked to the rail hook 181.

22. The lower thread supply device of claim 1, wherein a clearance for discharging the upper thread exists between the power transmission protrusion 210 and the protrusion receiving portion 320 in a state in which the power transmission protrusion 210 of the rotation plate 200 and the protrusion receiving portion 320 of the hook body 300 are engaged.

23. The lower thread supply device of claim 2, wherein in a state in which the power transmission protrusion 210 of the rotation plate 200 and the protrusion receiving portion 320 of the hook body 300 are engaged, a clearance for discharging the upper thread is secured between the power transmission protrusion 210 and the protrusion receiving portion 320.

24. The lower thread supply device of claim 3, wherein in a state in which the power transmission protrusion 210 of the rotation plate 200 and the protrusion receiving portion 320 of the hook body 300 are engaged, a clearance for discharging the upper thread is secured between the power transmission protrusion 210 and the protrusion receiving portion 320.

25. The lower thread supply device of claim 4, wherein in a state in which the power transmission protrusion 210 of the rotation plate 200 and the protrusion receiving portion 320 of the hook body 300 are engaged, a clearance for discharging the upper thread is secured between the power transmission protrusion 210 and the protrusion receiving portion 320.

26. The lower thread supply device of claim 5, wherein in a state in which the power transmission protrusion 210 of the rotation plate 200 and the protrusion receiving portion 320 of the hook body 300 are engaged, a clearance for discharging the upper thread is secured between the power transmission protrusion 210 and the protrusion receiving portion 320.

27. The lower thread supply device of claim 6, wherein in a state in which the power transmission protrusion 210 of the rotation plate 200 and the protrusion receiving portion 320 of the hook body 300 are engaged, a clearance for discharging the upper thread is secured between the power transmission protrusion 210 and the protrusion receiving portion 320.

28. The lower thread supply device of claim 7, wherein in a state in which the power transmission protrusion 210 of the rotation plate 200 and the protrusion receiving portion 320 of the hook body 300 are engaged, a clearance for discharging the upper thread is secured between the power transmission protrusion 210 and the protrusion receiving portion 320.

29. The lower thread supply device of claim 2, wherein the rotation plate 200 comprises:

a coupling binding portion 230 that is protruded from a rear surface of a circular plate to maintain a constant gap;

a coupling 250 having a power shaft binding hole 240 that inserts and couples a power shaft of the sewing machine at the center and that is radially extended about the power shaft binding hole 240 to be housed to space between the coupling binding portion 230; and a coupling separation prevention plate 260 having a hollow that passes through the power shaft of the sewing machine passes at the center and that is coupled to a rear end surface of the coupling binding portion 230 to prevent the coupling 250 from separating, wherein the coupling 250 secures a clearance in the front-rear direction in a state coupled to the coupling binding portion 230, and a range of the clearance is limited to a range that does not release engagement between the power transmission protrusion 210 of the rotation plate 200 and the protrusion receiving portion 320 of the hook body 300.

30. The lower thread supply device of claim 3, wherein the rotation plate 200 comprises:

a coupling binding portion 230 that is protruded from a rear surface of a circular plate to maintain a constant gap;

a coupling 250 having a power shaft binding hole 240 that inserts and couples a power shaft of the sewing machine at the center and that is radially extended about the power shaft binding hole 240 to be housed to space between the coupling binding portion 230; and a coupling separation prevention plate 260 having a hollow that passes through the power shaft of the sewing machine passes at the center and that is coupled to a rear end surface of the coupling binding portion 230 to prevent the coupling 250 from separating, wherein the coupling 250 secures a clearance in the front-rear direction in a state coupled to the coupling binding portion 230, and a range of the clearance is limited to a range that does not release engagement between the power transmission protrusion 210 of the rotation plate 200 and the protrusion receiving portion 320 of the hook body 300.

31. The lower thread supply device of claim 4, wherein the rotation plate 200 comprises:

a coupling binding portion 230 that is protruded from a rear surface of a circular plate to maintain a constant gap;

a coupling 250 having a power shaft binding hole 240 that inserts and couples a power shaft of the sewing machine at the center and that is radially extended about the power shaft binding hole 240 to be housed to space between the coupling binding portion 230; and a coupling separation prevention plate 260 having a hollow that passes through the power shaft of the sewing machine passes at the center and that is coupled to a rear end surface of the coupling binding portion 230 to prevent the coupling 250 from separating, wherein the coupling 250 secures a clearance in the front-rear direction in a state coupled to the coupling binding portion 230, and a range of the clearance is limited to a range that does not release engagement between the power transmission protrusion 210 of the rotation plate 200 and the protrusion receiving portion 320 of the hook body 300.

32. The lower thread supply device of claim 5, wherein the rotation plate 200 comprises:

a coupling binding portion 230 that is protruded from a rear surface of a circular plate to maintain a constant gap;

a coupling 250 having a power shaft binding hole 240 that inserts and couples a power shaft of the sewing machine at the center and that is radially extended about the power shaft binding hole 240 to be housed to space between the coupling binding portion 230; and a coupling separation prevention plate 260 having a hollow that passes through the power shaft of the sewing machine passes at the center and that is coupled to a rear end surface of the coupling binding portion 230 to prevent the coupling 250 from separating, wherein the coupling 250 secures a clearance in the front-rear direction in a state coupled to the coupling binding portion 230, and a range of the clearance is limited to a range that does not release engagement between the power transmission protrusion 210 of the rotation plate 200 and the protrusion receiving portion 320 of the hook body 300.

33. The lower thread supply device of claim 6, wherein the rotation plate 200 comprises:

a coupling binding portion 230 that is protruded from a rear surface of a circular plate to maintain a constant gap;

a coupling 250 having a power shaft binding hole 240 that inserts and couples a power shaft of the sewing machine at the center and that is radially extended about the power shaft binding hole 240 to be housed to space between the coupling binding portion 230; and a coupling separation prevention plate 260 having a hollow that passes through the power shaft of the sewing machine passes at the center and that is coupled to a rear end surface of the coupling binding portion 230 to prevent the coupling 250 from separating, wherein the coupling 250 secures a clearance in the front-rear direction in a state coupled to the coupling binding portion 230, and a range of the clearance is limited to a range that does not release engagement between the power transmission protrusion 210 of the rotation plate 200 and the protrusion receiving portion 320 of the hook body 300.

34. The lower thread supply device of claim 7, wherein the rotation plate 200 comprises:

a coupling binding portion 230 that is protruded from a rear surface of a circular plate to maintain a constant gap;

a coupling 250 having a power shaft binding hole 240 that inserts and couples a power shaft of the sewing machine at the center and that is radially extended about the power shaft binding hole 240 to be housed to space between the coupling binding portion 230; and a coupling separation prevention plate 260 having a hollow that passes through the power shaft of the sewing machine passes at the center and that is coupled to a rear end surface of the coupling binding portion 230 to prevent the coupling 250 from separating, wherein the coupling 250 secures a clearance in the front-rear direction in a state coupled to the coupling binding portion 230, and a range of the clearance is limited to a range that does not release engagement between the power transmission protrusion 210 of the rotation plate 200 and the protrusion receiving portion 320 of the hook body 300.

35. The lower thread supply device of claim 2, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a bar code 610 that is attached toward the center along an inner side surface of the flange 420 of the bobbin 400 and in which a plurality of position information is stored according to a radius of the flange 420; and a bar code sensor 620 that is installed at the sensor mounting device 170 of the housing 100 to sense the bar code 610 and to detect the remaining amount of the lower thread.

36. The lower thread supply device of claim 3, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a bar code 610 that is attached toward the center along an inner side surface of the flange 420 of the bobbin 400 and in which a plurality of position information is stored according to a radius of the flange 420; and a bar code sensor 620 that is installed at the sensor mounting device 170 of the housing 100 to sense the bar code 610 and to detect the remaining amount of the lower thread.

37. The lower thread supply device of claim 4, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a bar code 610 that is attached toward the center along an inner side surface of the flange 420 of the bobbin 400 and in which a plurality of position information is stored according to a radius of the flange 420; and a bar code sensor 620 that is installed at the sensor mounting device 170 of the housing 100 to sense the bar code 610 and to detect the remaining amount of the lower thread.

38. The lower thread supply device of claim 5, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a bar code 610 that is attached toward the center along an inner side surface of the flange 420 of the bobbin 400 and in which a plurality of position information is stored according to a radius of the flange 420; and a bar code sensor 620 that is installed at the sensor mounting device 170 of the housing 100 to sense the bar code 610 and to detect the remaining amount of the lower thread.

39. The lower thread supply device of claim 6, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a bar code 610 that is attached toward the center along an inner side surface of the flange 420 of the bobbin 400 and in which a plurality of position information is stored according to a radius of the flange 420; and a bar code sensor 620 that is installed at the sensor mounting device 170 of the housing 100 to sense the bar code 610 and to detect the remaining amount of the lower thread.

40. The lower thread supply device of claim 7, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a bar code 610 that is attached toward the center along an inner side surface of the flange 420 of the bobbin 400 and in which a plurality of position information is stored according to a radius of the flange 420; and a bar code sensor 620 that is installed at the sensor mounting device 170 of the housing 100 to sense the bar code 610 and to detect the remaining amount of the lower thread.

41. The lower thread supply device of claim 2, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of the rotation shaft 410, the lower thread supply device further comprises:

a bar code 610 that is attached in a direction parallel to the rotation shaft 410 along an outer circumferential surface of the rotation shaft 410 of the bobbin 400 and in which a plurality of position information is stored according to a region of the rotation shaft 410; and a bar code sensor 620 that is installed at the sensor mounting device 170 of the housing 100 to sense the bar code 610 and to detect the remaining amount of the lower thread.

42. The lower thread supply device of claim 3, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of the rotation shaft 410, the lower thread supply device further comprises:

a bar code 610 that is attached in a direction parallel to the rotation shaft 410 along an outer circumferential surface of the rotation shaft 410 of the bobbin 400 and in which a plurality of position information is stored according to a region of the rotation shaft 410; and a bar code sensor 620 that is installed at the sensor mounting device 170 of the housing 100 to sense the bar code 610 and to detect the remaining amount of the lower thread.

43. The lower thread supply device of claim 4, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of the rotation shaft 410, the lower thread supply device further comprises:

a bar code 610 that is attached in a direction parallel to the rotation shaft 410 along an outer circumferential surface of the rotation shaft 410 of the bobbin 400 and in which a plurality of position information is stored according to a region of the rotation shaft 410; and a bar code sensor 620 that is installed at the sensor mounting device 170 of the housing 100 to sense the bar code 610 and to detect the remaining amount of the lower thread.

44. The lower thread supply device of claim 5, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of the rotation shaft 410, the lower thread supply device further comprises:

a bar code 610 that is attached in a direction parallel to the rotation shaft 410 along an outer circumferential surface of the rotation shaft 410 of the bobbin 400 and in which a plurality of position information is stored according to a region of the rotation shaft 410; and a bar code sensor 620 that is installed at the sensor mounting device 170 of the housing 100 to sense the bar code 610 and to detect the remaining amount of the lower thread.

45. The lower thread supply device of claim 6, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of the rotation shaft 410, the lower thread supply device further comprises:

a bar code 610 that is attached in a direction parallel to the rotation shaft 410 along an outer circumferential surface of the rotation shaft 410 of the bobbin 400 and in which a plurality of position information is stored according to a region of the rotation shaft 410; and a bar code sensor 620 that is installed at the sensor mounting device 170 of the housing 100 to sense the bar code 610 and to detect the remaining amount of the lower thread.

46. The lower thread supply device of claim 7, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of the rotation shaft 410, the lower thread supply device further comprises:

a bar code 610 that is attached in a direction parallel to the rotation shaft 410 along an outer circumferential surface of the rotation shaft 410 of the bobbin 400 and in which a plurality of position information is stored according to a region of the rotation shaft 410; and a bar code sensor 620 that is installed at the sensor mounting device 170 of the housing 100 to sense the bar code 610 and to detect the remaining amount of the lower thread.

47. The lower thread supply device of claim 2, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a plurality of optical sensors 660 that are separately installed toward the center along an inner side surface of the flange 420 of the bobbin 400;

an RFID tag 670 that is connected to the optical sensor 660 to transmit a signal transferred from each optical sensor 660; and an RFID reader 680 that receives a signal transmitted from the RFID tag 670 and that determines whether the signal is a signal transmitted from the optical sensor 660 installed at any position of the flange 420 and that detects the remaining amount of the lower thread wound in the bobbin 400.

48. The lower thread supply device of claim 3, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a plurality of optical sensors 660 that are separately installed toward the center along an inner side surface of the flange 420 of the bobbin 400;

an RFID tag 670 that is connected to the optical sensor 660 to transmit a signal transferred from each optical sensor 660; and an RFID reader 680 that receives a signal transmitted from the RFID tag 670 and that determines whether the signal is a signal transmitted from the optical sensor 660 installed at any position of the flange 420 and that detects the remaining amount of the lower thread wound in the bobbin 400.

49. The lower thread supply device of claim 4, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a plurality of optical sensors 660 that are separately installed toward the center along an inner side surface of the flange 420 of the bobbin 400;

an RFID tag 670 that is connected to the optical sensor 660 to transmit a signal transferred from each optical sensor 660; and an RFID reader 680 that receives a signal transmitted from the RFID tag 670 and that determines whether the signal is a signal transmitted from the optical sensor 660 installed at any position of the flange 420 and that detects the remaining amount of the lower thread wound in the bobbin 400.

50. The lower thread supply device of claim 5, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a plurality of optical sensors 660 that are separately installed toward the center along an inner side surface of the flange 420 of the bobbin 400;

an RFID tag 670 that is connected to the optical sensor 660 to transmit a signal transferred from each optical sensor 660; and an RFID reader 680 that receives a signal transmitted from the RFID tag 670 and that determines whether the signal is a signal transmitted from the optical sensor 660 installed at any position of the flange 420 and that detects the remaining amount of the lower thread wound in the bobbin 400.

51. The lower thread supply device of claim 6, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a plurality of optical sensors 660 that are separately installed toward the center along an inner side surface of the flange 420 of the bobbin 400;

an RFID tag 670 that is connected to the optical sensor 660 to transmit a signal transferred from each optical sensor 660; and an RFID reader 680 that receives a signal transmitted from the RFID tag 670 and that determines whether the signal is a signal transmitted from the optical sensor 660 installed at any position of the flange 420 and that detects the remaining amount of the lower thread wound in the bobbin 400.

52. The lower thread supply device of claim 7, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of the rotation shaft 410, the lower thread supply device further comprises:

a plurality of optical sensors 660 that are separately installed toward the center along an inner side surface of the flange 420 of the bobbin 400;

an RFID tag 670 that is connected to the optical sensor 660 to transmit a signal transferred from each optical sensor 660; and an RFID reader 680 that receives a signal transmitted from the RFID tag 670 and that determines whether the signal is a signal transmitted from the optical sensor 660 installed at any position of the flange 420 and that detects the remaining amount of the lower thread wound in the bobbin 400.

53. The lower thread supply device of claim 2, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of a rotation shaft 410, the lower thread supply device further comprises:

a plurality of optical sensors 660 that are separately installed in a direction parallel to the rotation shaft 410 along an outer circumferential surface of the rotation shaft 410 of the bobbin 400;

an RFID tag 670 that is connected to the optical sensor 660 to transmit a signal transferred from each optical sensor 660; and an RFID reader 680 that receives the signal transmitted from the RFID tag 670 and that determines whether the signal is a signal transmitted from the optical sensor 660 installed at any position of the rotation shaft 410 and that detects the remaining amount of the lower thread wound in the bobbin 400.

54. The lower thread supply device of claim 3, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of a rotation shaft 410, the lower thread supply device further comprises:

a plurality of optical sensors 660 that are separately installed in a direction parallel to the rotation shaft 410 along an outer circumferential surface of the rotation shaft 410 of the bobbin 400;

an RFID tag 670 that is connected to the optical sensor 660 to transmit a signal transferred from each optical sensor 660; and an RFID reader 680 that receives the signal transmitted from the RFID tag 670 and that determines whether the signal is a signal transmitted from the optical sensor 660 installed at any position of the rotation shaft 410 and that detects the remaining amount of the lower thread wound in the bobbin 400.

55. The lower thread supply device of claim 4, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of a rotation shaft 410, the lower thread supply device further comprises:

a plurality of optical sensors 660 that are separately installed in a direction parallel to the rotation shaft 410 along an outer circumferential surface of the rotation shaft 410 of the bobbin 400;

an RFID tag 670 that is connected to the optical sensor 660 to transmit a signal transferred from each optical sensor 660; and an RFID reader 680 that receives the signal transmitted from the RFID tag 670 and that determines whether the signal is a signal transmitted from the optical sensor 660 installed at any position of the rotation shaft 410 and that detects the remaining amount of the lower thread wound in the bobbin 400.

56. The lower thread supply device of claim 5, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of a rotation shaft 410, the lower thread supply device further comprises:

a plurality of optical sensors 660 that are separately installed in a direction parallel to the rotation shaft 410 along an outer circumferential surface of the rotation shaft 410 of the bobbin 400;

an RFID tag 670 that is connected to the optical sensor 660 to transmit a signal transferred from each optical sensor 660; and an RFID reader 680 that receives the signal transmitted from the RFID tag 670 and that determines whether the signal is a signal transmitted from the optical sensor 660 installed at any position of the rotation shaft 410 and that detects the remaining amount of the lower thread wound in the bobbin 400.

57. The lower thread supply device of claim 6, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of a rotation shaft 410, the lower thread supply device further comprises:

a plurality of optical sensors 660 that are separately installed in a direction parallel to the rotation shaft 410 along an outer circumferential surface of the rotation shaft 410 of the bobbin 400;

an RFID tag 670 that is connected to the optical sensor 660 to transmit a signal transferred from each optical sensor 660; and an RFID reader 680 that receives the signal transmitted from the RFID tag 670 and that determines whether the signal is a signal transmitted from the optical sensor 660 installed at any position of the rotation shaft 410 and that detects the remaining amount of the lower thread wound in the bobbin 400.

58. The lower thread supply device of claim 7, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which a flange 420 is provided at both end portions of a rotation shaft 410, the lower thread supply device further comprises:

a plurality of optical sensors 660 that are separately installed in a direction parallel to the rotation shaft 410 along an outer circumferential surface of the rotation shaft 410 of the bobbin 400;

an RFID tag 670 that is connected to the optical sensor 660 to transmit a signal transferred from each optical sensor 660; and an RFID reader 680 that receives the signal transmitted from the RFID tag 670 and that determines whether the signal is a signal transmitted from the optical sensor 660 installed at any position of the rotation shaft 410 and that detects the remaining amount of the lower thread wound in the bobbin 400.

59. The lower thread supply device of claim 2, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of a rotation shaft 410, the lower thread supply device further comprises:

a laser distance measuring device (not shown) that is installed in the sensor mounting device 170 of the housing 100 to detect the remaining amount of the lower thread by sensing a distance to a surface of the lower thread wound in the bobbin 400.

60. The lower thread supply device of claim 3, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of a rotation shaft 410, the lower thread supply device further comprises:

a laser distance measuring device (not shown) that is installed in the sensor mounting device 170 of the housing 100 to detect the remaining amount of the lower thread by sensing a distance to a surface of the lower thread wound in the bobbin 400.

61. The lower thread supply device of claim 4, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of a rotation shaft 410, the lower thread supply device further comprises:

a laser distance measuring device (not shown) that is installed in the sensor mounting device 170 of the housing 100 to detect the remaining amount of the lower thread by sensing a distance to a surface of the lower thread wound in the bobbin 400.

62. The lower thread supply device of claim 5, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of a rotation shaft 410, the lower thread supply device further comprises:

a laser distance measuring device (not shown) that is installed in the sensor mounting device 170 of the housing 100 to detect the remaining amount of the lower thread by sensing a distance to a surface of the lower thread wound in the bobbin 400.

63. The lower thread supply device of claim 6, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of a rotation shaft 410, the lower thread supply device further comprises:

a laser distance measuring device (not shown) that is installed in the sensor mounting device 170 of the housing 100 to detect the remaining amount of the lower thread by sensing a distance to a surface of the lower thread wound in the bobbin 400.

64. The lower thread supply device of claim 7, wherein at an outer circumferential surface of the other side of the housing 100, a sensor mounting device 170 is penetrated, at an outer circumferential surface of one side of the hook body 300, a light transmission device 370 is penetrated to correspond to the sensor mounting device 170, and the bobbin 400 has a spool shape in which the flange 420 is provided at both end portions of a rotation shaft 410, the lower thread supply device further comprises:

a laser distance measuring device (not shown) that is installed in the sensor mounting device 170 of the housing 100 to detect the remaining amount of the lower thread by sensing a distance to a surface of the lower thread wound in the bobbin 400.

65. The lower thread supply device of claim 15, wherein a clearance for discharging the upper thread exists between the power transmission protrusion 210 and the protrusion receiving portion 320 in a state in which the power transmission protrusion 210 of the rotation plate 200 and the protrusion receiving portion 320 of the hook body 300 are engaged.

66. The lower thread supply device of claim 16, wherein a clearance for discharging the upper thread exists between the power transmission protrusion 210 and the protrusion receiving portion 320 in a state in which the power transmission protrusion 210 of the rotation plate 200 and the protrusion receiving portion 320 of the hook body 300 are engaged.

67. The lower thread supply device of claim 17, wherein a clearance for discharging the upper thread exists between the power transmission protrusion 210 and the protrusion receiving portion 320 in a state in which the power transmission protrusion 210 of the rotation plate 200 and the protrusion receiving portion 320 of the hook body 300 are engaged.

68. The lower thread supply device of claim 18, wherein a clearance for discharging the upper thread exists between the power transmission protrusion 210 and the protrusion receiving portion 320 in a state in which the power transmission protrusion 210 of the rotation plate 200 and the protrusion receiving portion 320 of the hook body 300 are engaged.

69. The lower thread supply device of claim 19, wherein a clearance for discharging the upper thread exists between the power transmission protrusion 210 and the protrusion receiving portion 320 in a state in which the power transmission protrusion 210 of the rotation plate 200 and the protrusion receiving portion 320 of the hook body 300 are engaged.

70. The lower thread supply device of claim 30, wherein a clearance for discharging the upper thread exists between the power transmission protrusion 210 and the protrusion receiving portion 320 in a state in which the power transmission protrusion 210 of the rotation plate 200 and the protrusion receiving portion 320 of the hook body 300 are engaged.

71. The lower thread supply device of claim 21, wherein a clearance for discharging the upper thread exists between the power transmission protrusion 210 and the protrusion receiving portion 320 in a state in which the power transmission protrusion 210 of the rotation plate 200 and the protrusion receiving portion 320 of the hook body 300 are engaged.

* * * * *